US008015639B2

(12) United States Patent
Boudreau

(10) Patent No.: US 8,015,639 B2
(45) Date of Patent: Sep. 13, 2011

(54) FOLDING BED

(76) Inventor: Martin Boudreau, St-Joachim de Courval (CA)

( * ) Notice: Subject to any disclaimer, the term of this patent is extended or adjusted under 35 U.S.C. 154(b) by 0 days.

(21) Appl. No.: 12/805,277

(22) Filed: Jul. 22, 2010

(65) Prior Publication Data

US 2010/0293710 A1 Nov. 25, 2010

Related U.S. Application Data

(63) Continuation of application No. 11/628,456, filed as application No. PCT/CA2005/001025 on Jun. 23, 2005, now Pat. No. 7,810,189.

(30) Foreign Application Priority Data

Jun. 23, 2004 (CA) ..... 2471005
Sep. 7, 2004 (CA) ..... 2507453

(51) Int. Cl.
*A61G 7/015* (2006.01)
*A47C 17/175* (2006.01)
*A47C 19/22* (2006.01)

(52) U.S. Cl. ..... 5/618; 5/613; 5/308

(58) Field of Classification Search ..... 5/618, 613, 5/616, 617, 610, 600, 308, 904, 905; 297/83
See application file for complete search history.

(56) References Cited

U.S. PATENT DOCUMENTS 7,810,189 B2 * 10/2010 Boudreau ..... 5/618
2007/0245489 A1 * 10/2007 Boudreau ..... 5/174

* cited by examiner

*Primary Examiner* — Robert G Santos

(57) ABSTRACT

A folding bed for supporting an intended user having a torso and a pair of lower limbs. First and second supporting sections are provided for supporting respectively the torso and the lower limbs and are pivotally coupled together through a first-to-second section pivotal link for pivotal movement between an extended configuration and a bent configuration. When the first and second supporting sections are respectively in the extended and bent configurations, the first-to-second section pivotal link is respectively at a first and a second level relative to the frame base, the second level being substantially lower than the first level. The first and second supporting sections are movable by the intended user between the extended and bent configurations with the intended user laying in the bed and moving the torso with respect to the lower limbs to change an angle therebetween and cause a corresponding change in an angle between the first and second supporting sections.

20 Claims, 20 Drawing Sheets

FOLDING BED

The present application is a Continuation of U.S. patent application Ser. No. 11/628,456 filed on Dec. 4, 2006, now U.S. Pat. No. 7,810,189, which is a US National Stage Entry of PCT Patent Application Serial Number PCT/CA05/01025 filed on Jun. 23, 2005, which claimed priority from Canadian Patent Application Serial Number 2,471,005 filed Jun. 23, 2004 and Canadian Patent Application Serial Number 2,507,453 filed Sep. 7, 2004. The aforementioned applications are hereby incorporated by reference herein in their entirety.

FIELD OF THE INVENTION

The present invention relates to beds. More specifically, the present invention is concerned with an improved folding bed.

BACKGROUND OF THE INVENTION

Folding beds allowing a user to alternatively assume an elongated position and a seated position come in many types. Most of these folding beds include a plurality of segments that pivot relative to each other through the use of motors. The motors allow moving the segments so that the bed allows the user to either achieve the elongated position or the seated position.

Since these beds typically use motors, they are relatively heavy, relatively expensive to manufacture and relatively complex. Furthermore, most of these beds assume the seated position by lifting the rear segment of the bed, which supports the torso of the intended user. Some of these existing folding beds include a storage space adjacent the footboard of the bed. Beds having the above-described configuration prevent the access to this storage space from above as the mattress blocks the access to the top of the storage space.

Another problem with currently existing folding beds resides in that mattresses typically need to be relatively thick to be comfortable but need to be relatively thin to be easily folded to achieve the folded configuration. These two conflicting requirements result in mattresses that are only a compromise between these two desired characteristics.

Against this background, there exists a need in the industry to provide a novel folding bed. An object of the present invention is therefore to provide an improved folding bed.

SUMMARY OF THE INVENTION

In a broad aspect, the invention provides a folding bed for supporting an intended user in both an elongated configuration and a seated configuration. The intended user has a torso, a pair of lower limbs and a hip region therebetween. The folding bed includes a bed frame having a frame base. A first supporting section is provided for supporting the torso, the first supporting section defining a first supporting section first end and a longitudinally opposed first supporting section second end. A second supporting section is further provided for supporting the lower limbs, the second supporting section defining a second supporting section first end and a longitudinally opposed second supporting section second end. The first and second sections are angled relative to each other by a first-to-second section angle. The first and second supporting sections are pivotally coupled together through a first-to-second section pivotal link for pivotal movement between an extended configuration and a bent configuration. In the extended configuration, the first and second supporting sections are in substantially co-planar relationship with respect to each other and, in the bent configuration, the first-to-second section angle has a value smaller than 180 degrees. A first support member defines a first support member first end and a longitudinally opposed first support member second end. The first support member first end is pivotally attached to the first supporting section intermediate the first supporting section first end and the first supporting section second end at a section pivotal link-to-first support member distance from the pivotal link. The first support member second end is mechanically coupled to the frame base in a manner such that when the first and second supporting sections are in the extended configuration, the first-to-second section pivotal link is at a first level relative to the frame base. When the first and second supporting sections are in the bent configuration, the first-to-second section pivotal link is at a second level relative to the frame base, the second level being substantially lower than the first level. The first and second supporting sections are movable by the intended user between said extended and bent configurations with the intended user laying in the bed and moving the torso with respect to the lower limbs to change a torso-to-lower limbs angle between the torso and the lower limbs and cause a corresponding change in the first-to-second section angle Advantageously, the folding bed is operable between the extended configuration and the bent configuration by the intended user without requiring that the intended user stands up from the folding bed.

In addition, the folding bed is relatively ergonomic and usable without requiring special tooling or manual dexterity. Furthermore, the folding bed is relatively inexpensive to manufacture and relatively lightweight.

Yet furthermore, in some embodiments of the invention, the second supporting section is retracted towards the first supporting section when achieving the bent configuration. This allows the intended user, when the folding bed is in the bent configuration, to access a storage compartment that is located under a mattress when the folding bed is in the extended configuration.

In some embodiments of the invention, a television, for example a so-called flat-screen television, or any other display device is stored in the storage compartment so that it is relatively easy to access and relatively conveniently positioned for use when the user is in the seated configuration. In other embodiments of the invention, the lid includes any other entertainment device.

Having the display stored under the second supporting section when the bed is in the extended configuration allows to store the display device with relatively small lost of space in a room into which the folding bed is installed.

In other embodiments of the invention, the folding bed includes a lower mattress and an upper mattress. The lower mattress is supported by a substantially flat lower mattress support. The first and second supporting sections form a peripheral frame from which a substantially resilient upper mattress support for supporting the upper mattress extends substantially inwardly. The lower mattress support is operatively coupled to the upper mattress support so that in the extended configuration, the lower mattress supports the upper mattress with the upper mattress support being untensioned between the upper and lower mattresses. In the bent configuration, the lower mattress is in spaced relationship relative to the upper mattress support, thereby causing the upper mattress to be supported by the upper mattress support.

Other objects, advantages and features of the present invention will become more apparent upon reading of the following non-restrictive description of preferred embodiments thereof, given by way of example only with reference to the accompanying drawings.

DETAILED DESCRIPTION

Figure 1:
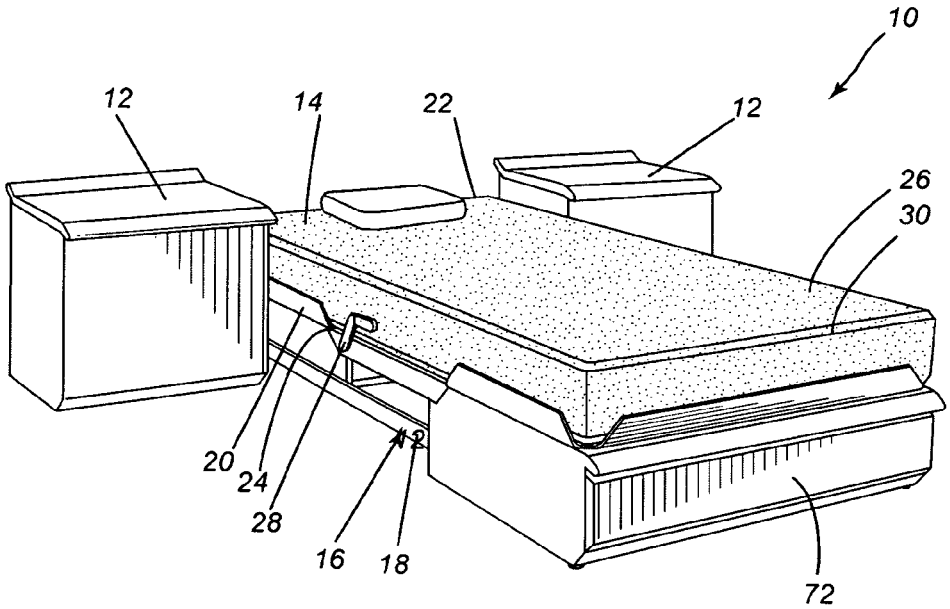
FIG. 1, in a perspective view, illustrates a folding bed in accordance with an embodiment of the present invention, the folding bed being shown with first and second supporting sections thereof in an extended configuration.

FIG. 1 illustrates a folding bed, generally indicated by the reference numeral 10, for supporting an intended user 350 (shown only in FIG. 2) in both an elongated configuration and in a seated configuration. The intended user 350 has a torso 352, a pair of lower limbs 354, and a hip region (not seen in FIG. 2) therebetween. Two night tables 12, which are not necessarily present in all embodiments of the invention, are shown substantially adjacent the folding bed 10.

In some embodiments of the invention, as shown in FIG. 1, the folding bed 10 includes a mattress 14. However, in other embodiments of the invention, the folding bed 10 does not include a mattress 14.

Figure 2:
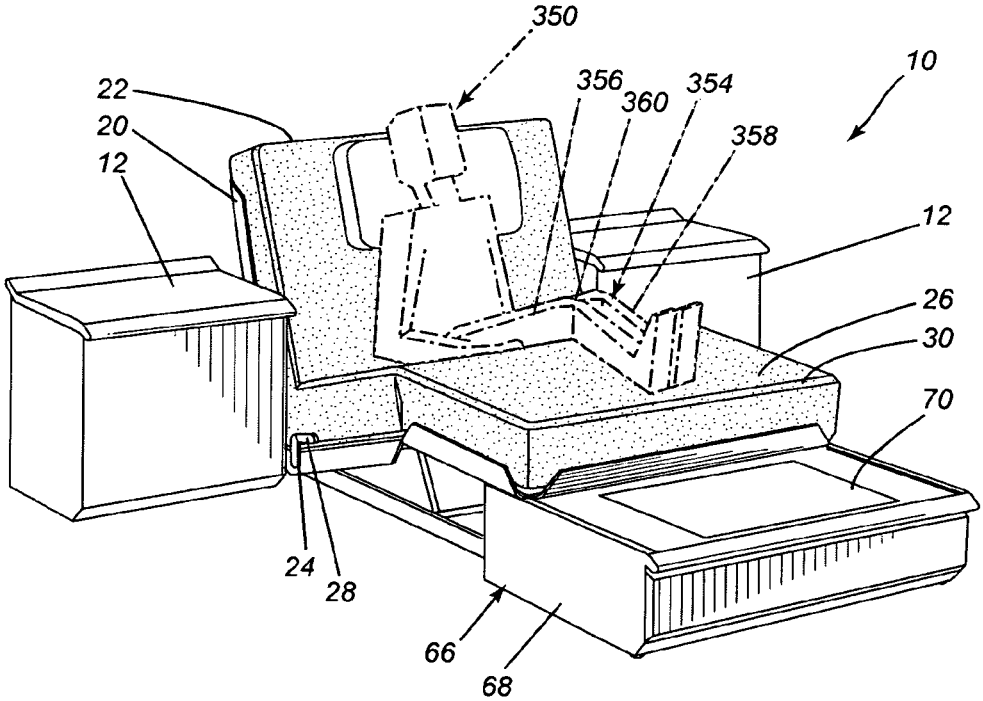
FIG. 2, in a perspective view, illustrates the folding bed of FIG. 1 with first and second supporting sections thereof in a bent configuration.

The folding bed 10 includes a bed frame 16 having a frame base 18. As better seen in FIG. 5, the bed frame 16 defines a bed frame first end 300 and a longitudinally opposed bed frame second end 302. Referring to FIG. 2, the folding bed 10 further includes a first supporting section 20 for supporting the torso 352 of the intended user 350. The first supporting section defines a first supporting section first end 22 and a longitudinally opposed first supporting section second end 24. A second supporting section 26 is provided for supporting the lower limbs 354 of the intended user 350. The second supporting section 26 defines a second supporting section first end 28 and a longitudinally opposed second supporting section second end 30.

Figure 5:
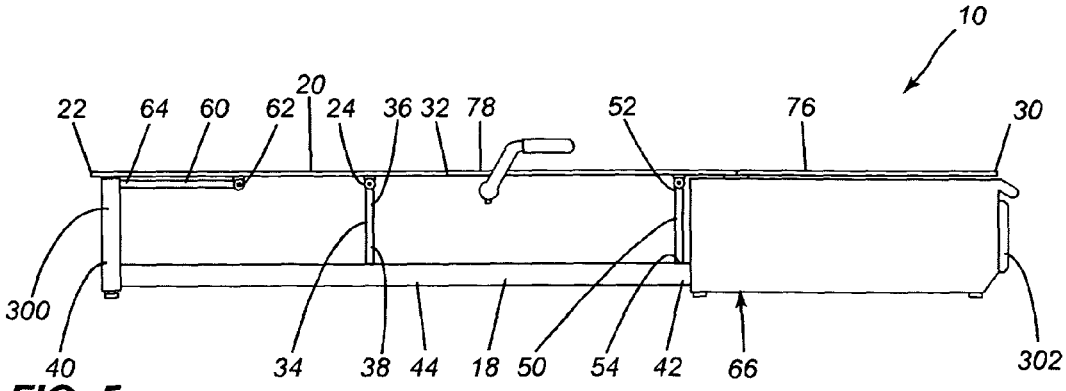
FIG. 5, in a side elevation view, illustrates the folding bed of FIG. 1 with the first and second supporting sections thereof in the extended configuration and the mattress thereof removed.
Figure 6:
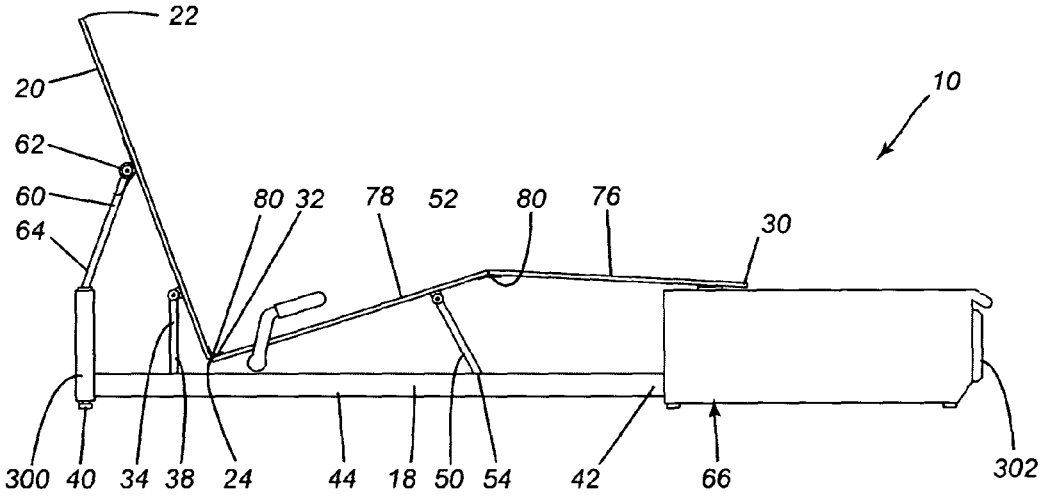
FIG. 6, in a side elevation view, illustrates the folding bed of FIG. 5 with the first and second supporting sections thereof in the bent configuration and the mattress thereof removed.
Figure 7:
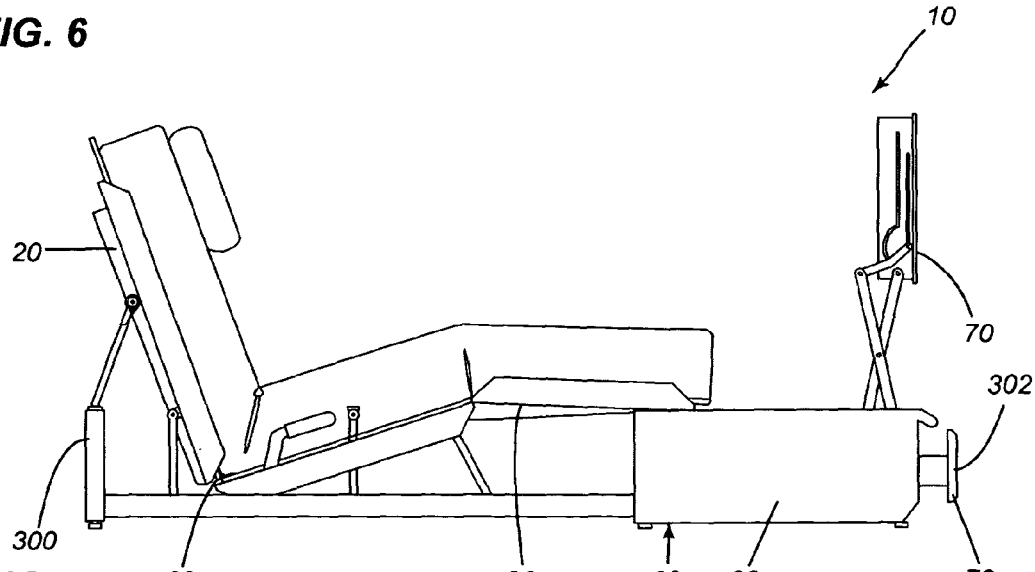
FIG. 7, in a side elevation view, illustrates the folding bed of FIG. 1 with the first and second supporting sections thereof in the bent configuration, the folding bed including a display device.

The first and second supporting sections 20 and 26 are pivotally connected together through a first-to-second section pivotal link 32, better illustrated in FIGS. 5 to 7, for allowing a pivotal movement between an extended configuration, shown in FIG. 1 and a bent configuration shown in FIG. 2. In the extended configuration, the first and second supporting sections 20 and 26 are in a substantially co-planar relationship with respect to each other. In the bent configuration, the first and second supporting sections 20 and 26 are angled relative to each other by a first-to-second section angle having a value smaller than 180 degrees.

Referring to FIGS. 5 and 6, the folding bed 10 includes a first support member 34 defining first support member first end 36 and a longitudinally opposed first support member second end 38. The first support member first end 36 is pivotally attached to the first supporting section 20 at a location intermediate the first supporting section first end 22 and the first supporting section second end 24 at a section pivotal link-to-first support member distance from the first-to-second section pivotal link 32. The first support member second end 38 is operatively coupled to the frame base 18 as follows.

When the first and second supporting sections 20 and 26 are in the extended configuration, as shown for example in FIGS. 1 and 5, the first-to-second section pivotal link 32 is at a first level relative to the frame base 18. When the first and second supporting sections 20 and 26 are in the bent configuration, as shown for example in FIGS. 2 and 6, the first-to-second section pivotal link 32 is at a second level relative to the frame base 18. The second level is substantially lower than the first level.

As shown in FIGS. 1 and 2, the folding bed 10 is relatively compact as no portion of the folding bed 10 protrudes substantially outwardly and laterally from the folding bed 10. This allows having the night tables 12 relatively close to the folding bed 10, which is often a desired characteristic of beds. Also, as further described hereinbelow, this allows to obtain a double bed by providing two folding bed similar to the folding bed 10 side-by-side. However, in alternative embodiments of the invention, portions of an alternative folding bed do protrude substantially outwardly and laterally from the alternative folding bed.

Figure 3:
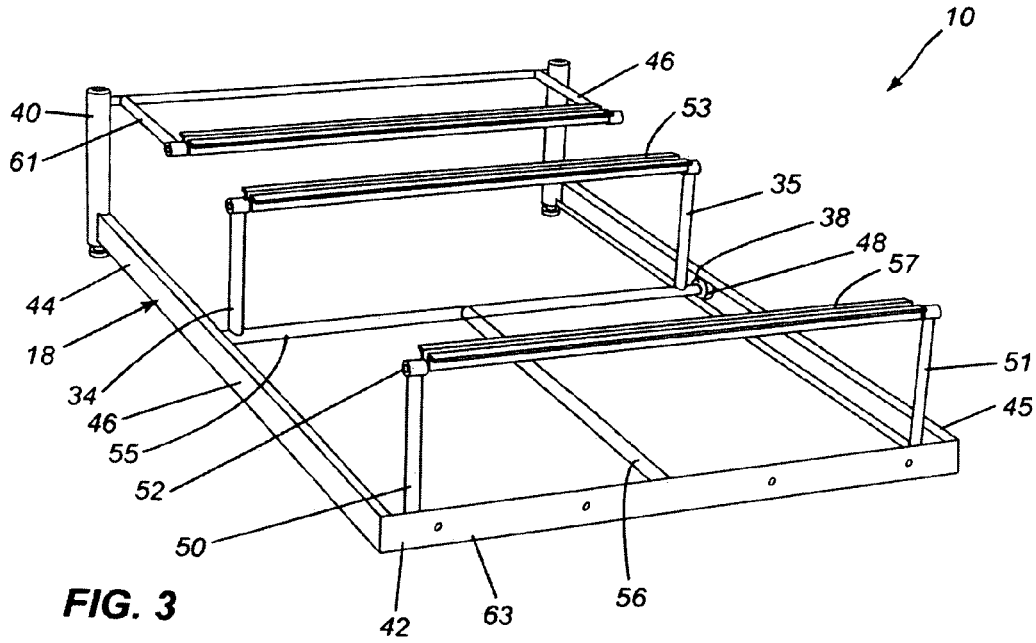
FIG. 3, in a perspective view, illustrates the folding bed of FIG. 1 with a mattress and supporting sections removed, the first and second supporting sections thereof being in the extended configuration.
Figure 4:
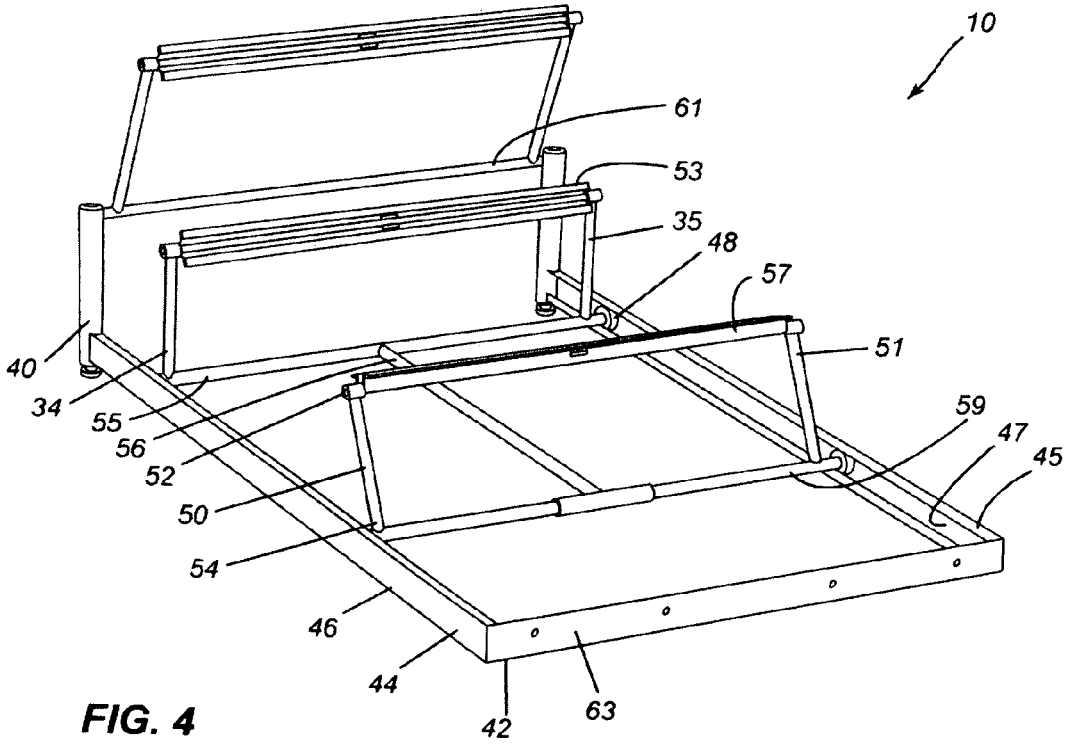
FIG. 4, in a perspective view, illustrates the folding bed of FIG. 1 with the mattress and supporting sections removed, the first and second supporting sections thereof being the bent configuration.

Referring to FIGS. 3 and 4, the frame base 18 defines a frame base first end 40 and a longitudinally opposed frame base second end 42. The frame base 18 includes a substantially longitudinally extending base guiding member 44. The first support member second end 38 is operatively coupled to the base guiding member 44 to allow a translational movement of the first support member second end 38 with respect to the base guiding member 44 when the first and second supporting sections 20 and 26 are moved between the extended configuration and the bent configuration.

The base guiding member 44 includes a rail 46 (the rail 46 is not well seen in the drawings, but a similar rail 47 included in another base guiding member 45 is shown in FIG. 4) and the first support member second end 38 includes a wheel 48 (also shown in FIG. 4 in relation with the base guiding member 45), the wheel 48 being operatively mounted to the rail 46 for slidable movement therealong. The rail 46 helps in insuring that the movements of the wheel 48 remains on a predetermined path even in the presence of external forces on the wheel 48 that would have a tendency to move the wheel 48 in directions substantially perpendicular to the rail 46. For example, if the intended user 350 exerts a lateral force on the folding bed 10, the wheel 48 would move substantially laterally under the exertion of this force if it was not retained by the rail 46 or in any other suitable manner.

The folding bed 10 further includes a second support member 50 defining a second support member first end 52 and a longitudinally opposed second support member second end 54. As shown in FIGS. 5 and 6, the second support member first end 52 is pivotally attached to the second supporting section 26 at a location intermediate the second supporting section first end 28 and the second supporting section second end 30 at a section pivotal link-to-second support member distance from the first-to-second section pivotal link 32.

In the folding bed 10, the second support member second end 54 is operatively coupled to the base guiding member 44 to allow a translational movement of the second support member second end 54 with respect to the base guiding member 44 when the first and second supporting sections 20 and 26 are moved between the elongated configuration and the bent configuration.

As better illustrated in FIGS. 3 and 4, in some embodiments of the invention, the folding bed 10 further includes a third support member 35 and a fourth support member 51. The frame base 18 further includes another base guiding member 45 including a rail 47. The third and a fourth support members 35 and 51 and the base guiding member 45 are laterally opposed and similar respectively to the first and second support members 34 and 50 and to the base guiding member 44. They will therefore not be described in further details herein.

As seen for example in FIGS. 3 and 4, the first and third support members 34 and 35 are linked to each other by first-to-third cross-members 53 and 55, while the second and fourth support members 50 and 51 are linked to each other by second-to-fourth cross-members 57 and 59. The first-to-third cross-members 53 and 55 and the second-to-fourth cross-members 57 and 59 are linked so that they move jointly with respect to the frame base 18 when the first and second supporting sections 20 and 26 are moved between the extended and the bent configurations.

The base guiding members 44 and 45 are also linked to each other by two frame base cross-members 61 and 63 provided respectively substantially adjacent the frame base first and second ends 40 and 42.

The reader skilled in the art will readily appreciate that the third and fourth support members 35 and 51, the first-to-third cross-members 53 and 55, the second-to-fourth cross-members 57 and 59 and the frame base cross-members 61 and 63 are not necessarily present in all embodiments of the invention and that the first and second support members 34 and 50 may take any other suitable form.

The first and second support members 34 and 50 are interconnected by a substantially rigid first-to-second support member interconnector 56. In the specific embodiment of the invention shown in FIGS. 3 and 4, the first-to-second support member interconnector 56 is linked respectively to the first and second support members 34 and 50 at locations substantially adjacent the first and second support members second ends 38 and 54.

Referring to FIGS. 5 and 6, the folding bed 10 further includes a retaining member 60 defining a retaining member first end 62 and a longitudinally opposed retaining member second end 64. The retaining member first end 62 is pivotally attached to the first supporting section 20 at a location intermediate the first supporting section first and second ends 22 and 24. The retaining member second end 64 is pivotally attached to the bed frame 16 at a location substantially adjacent the bed frame first end 300. The retaining member 60 constrains the movement of the first supporting section 20 such that when the first and second supporting sections 20 and 26 are moved from the elongated configuration to the bent configuration, the second supporting section second end 30 is moved towards the frame base first end 40.

In the extended configuration, the retaining member 60 is substantially horizontal and extends towards the frame base second end 42. In the bent configuration, the retaining member 60 is angled at an acute angle with respect to the base guiding member 44.

As better illustrated in FIGS. 2 and 7, in some embodiments of the invention, the bed frame 16 includes a storage compartment 66 provided substantially adjacent the frame base second end 42. The storage compartment 66 includes a storage compartment body 68 and a lid 70 pivotally linked to the storage compartment body 68. The lid 70 is operable between a lid closed position, shown in FIG. 2, wherein the lid 70 is substantially parallel to the frame base 18, and a lid opened position, shown for example in FIG. 7, wherein the lid 70 is substantially non-parallel to the frame base 18 and extends substantially outwardly and upwardly from the storage compartment body 68.

As shown in FIG. 1, the lid 70 is covered at least in part by the second supporting section 26 when the folding bed 10 is in the extended configuration. The lid 70 is substantially uncovered by the second supporting section 26 when the folding bed 10 is in the bent configuration, as shown in FIG. 2. This allows the operation of the lid 70 between the lid opened and closed positions.

The reader skilled in the art will readily appreciate that in other embodiments of the invention, a bed similar to the folding bed 10 does not include a storage compartment or does not include a lid similar to the lid 70. Also, as better illustrated in FIGS. 1, 2 and 7, in some embodiments of the invention, the storage compartment body 568 further receives a drawer 72 therein. Such drawers 72 are well known in the art and the drawer 72 will therefore not be described in further details.

Figure 14:
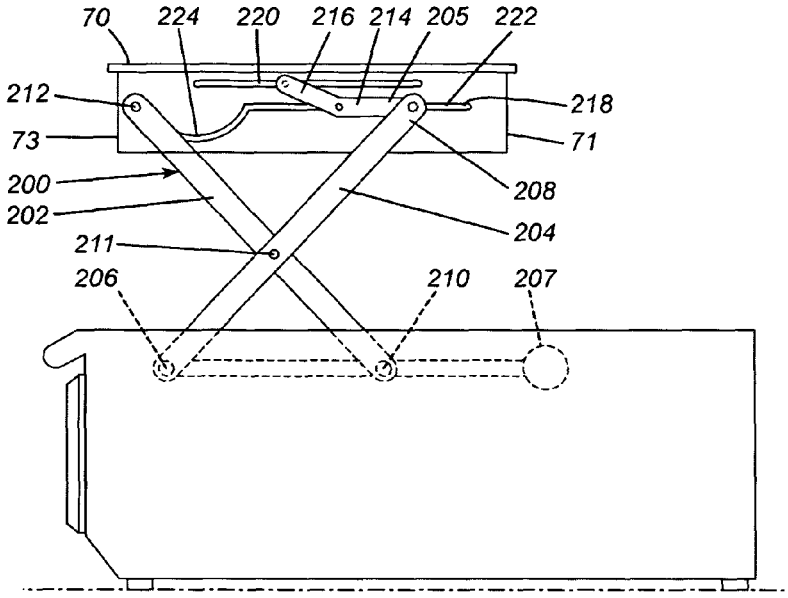
FIG. 14, in a side elevation view, illustrates the deployment of the display device of FIG. 7.
Figure 15:
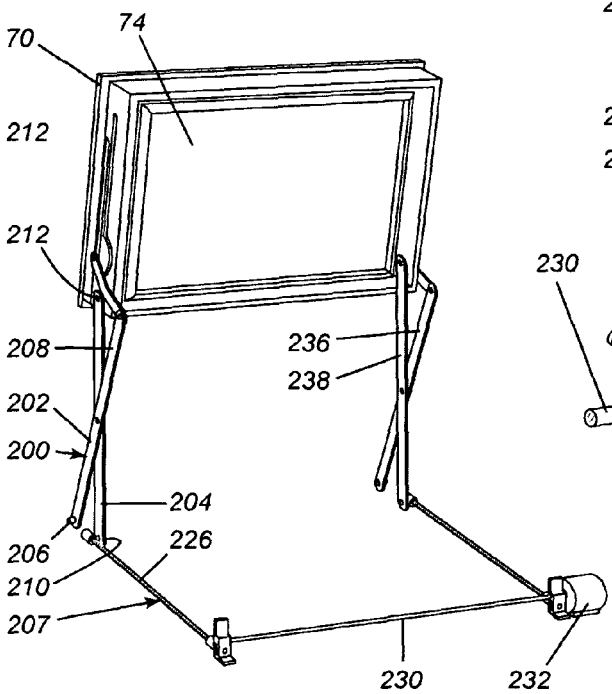
FIG. 15, in a perspective view, illustrates the display device of FIG. 7 in an open configuration.

Referring to FIG. 15, in some embodiments of the invention, the lid 70 includes an entertainment device in the form of a display device 74, such as, for example and non-limitatively, a flat screen television or monitor, among others. The flat screen television or monitor may take the form of a Liquid Crystal Display or a plasma display, among others. However, it is within the scope of the invention to have lids 70 that either does not include a display device 74, that include an alternative display device 74, or that include any other suitable entertainment device. An example of such another suitable entertainment device is a sound system, or speakers thereof, among others. Furthermore, referring to FIG. 14, the lid 70 defines a lid first end 71 and a longitudinally opposed lid second end 73.

As better seen in FIG. 14, the lid 70 is operated through a deployment mechanism 200. The deployment mechanism 200 includes first, second and third deployment members 202, 204 and 205. The deployment mechanism 200 further includes a lid actuator 207. Although the drawings and the description found hereinbelow illustrate a specific deployment mechanism 200, the reader skilled in the art will readily appreciate that folding beds 10 including any other suitable deployment mechanisms 200 are within the scope of the invention.

The first deployment member 202 defines a first deployment member first end 206 and a longitudinally opposed first deployment member second end 208. The first deployment member first end 206 is pivotally attached to the body 68, and the first deployment member second end 208 is pivotally attached to the third deployment member 205.

The second deployment member 204 defines a second deployment member first end 210 and a longitudinally opposed second deployment member second end 212. The second deployment member second end 212 is pivotally attached to the lid 70 substantially adjacent the lid second end 73, and the second deployment member first end 210 is operatively coupled to the lid actuator 207 as described in further details hereinbelow. The first and second deployment members 202 and 204 are pivotally linked at a first-to-second deployment members pivotal link 211 located intermediate the first deployment member first and second ends 206 and 208 and located intermediate the second deployment member first and second ends 210 and 212.

The third deployment member 205 defines a third deployment member first segment 214 and a third deployment member second segment 216 extending therefrom substantially non-collinearly with respect thereto. The third deployment member first segment 214 is slidably and pivotally mounted within a first guiding groove 218 provided within the lid 70. The third deployment member second segment 216 is pivotally and slidably mounted to a second guiding groove 220 provided within the lid 70.

The first guiding groove 218 includes a substantially rectilinear first guiding groove first segment 222 provided substantially adjacent the lid first end 71 and a substantially arcuate first guiding groove second segment 224 extending therefrom. The first guiding groove second segment 224 is provided substantially adjacent the lid second end 73. The second guiding groove 220 is substantially rectilinear and substantially parallel to the first guiding groove first segment 222.

Figure 16:
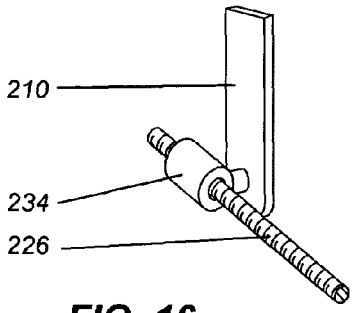
FIGS. 16 and 17, in a perspective view, illustrate respectively an electric motor and a linkage used for the deployment of the display of FIG. 7.
Figure 17:
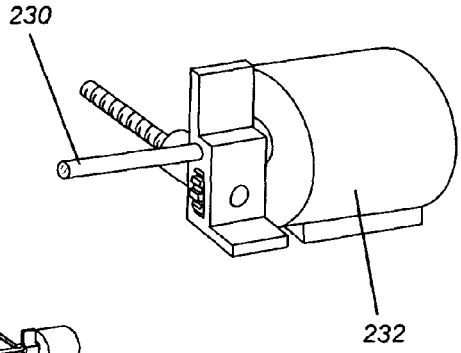

As better seen in FIG. 15, the lid actuator 207 includes a lid actuator guiding member and a motor 232 from which an axle 230 extends. The lid actuator guiding member takes the form of a threaded rod 226 mounted to the body 68 to allow the threaded rod 226 to rotate about the longitudinal axis of threaded. The motor 232 is operatively coupled to the axle 230 to selectively rotate the axle 230. The axle 230 is operatively coupled to the threaded rod 226 so that operating the motor 232 rotates the threaded rod 226 about its longitudinal axis. Referring to FIG. 16, the second deployment member first end 210 includes an internally threaded collar 234 mounted to the threaded rod 226.

Referring to FIG. 15, in some embodiments of the invention, two additional lid deployment members 236 and 238 similar to the first and second deployment members 202 and 204 are also provided. The lid deployment members 236 and 238 will not be described in further details are they are substantially similar to the first and second deployment members 202 and 204.

In some embodiments of the invention, the second supporting section 26 is operatively coupled to the storage compartment 66 so that the second supporting section 26 abuts against the storage compartment 66 while allowing a translational movement of the second supporting member 26 with respect to the storage compartment 66. In some of these embodiments of the invention, the second supporting member 26 is slideably coupled to the storage compartment 66. In other embodiments of the invention, not shown in the drawings, rollers are provided so that the second supporting member second end 30 may be rolled onto the storage compartment 66. In other embodiments of the invention, the supporting member 26 is coupled to the storage compartment 66 in any other suitable manner.

Referring to FIG. 2, lower limbs 354 include a lower limb portion 356 and an upper limb portion 358 articulated to the lower limb portion 356 at a knee region 360. The upper limb portion 358 extends between the hip region and the lower limb portion 356. In correspondence to these anatomical characteristics of the intended user 350, in some embodiments of the invention and as shown in FIGS. 5 and 6, the second supporting section 26 includes a second supporting section first segment 76 for supporting the lower limb portions 356 and a second supporting section second segment 78 for supporting upper limb portion 358. The second supporting section second segment 78 is pivotally linked to the second supporting section first segment 76. In some embodiments of the invention, the second support member 54 is attached to the second supporting section second segment 78.

In some embodiments of the invention, as shown in FIGS. 1 to 7, the first and second supporting sections 20 and 26 and the second supporting section first and second segments 76 and 78 are pivotally linked through the use of hinges 81, as better shown in FIG. 6. However, it is the scope of the invention to interlink the first and second supporting sections 20 and 26 and the second supporting section first and second segments 76 and 78 in any other suitable manner.

Figure 8:
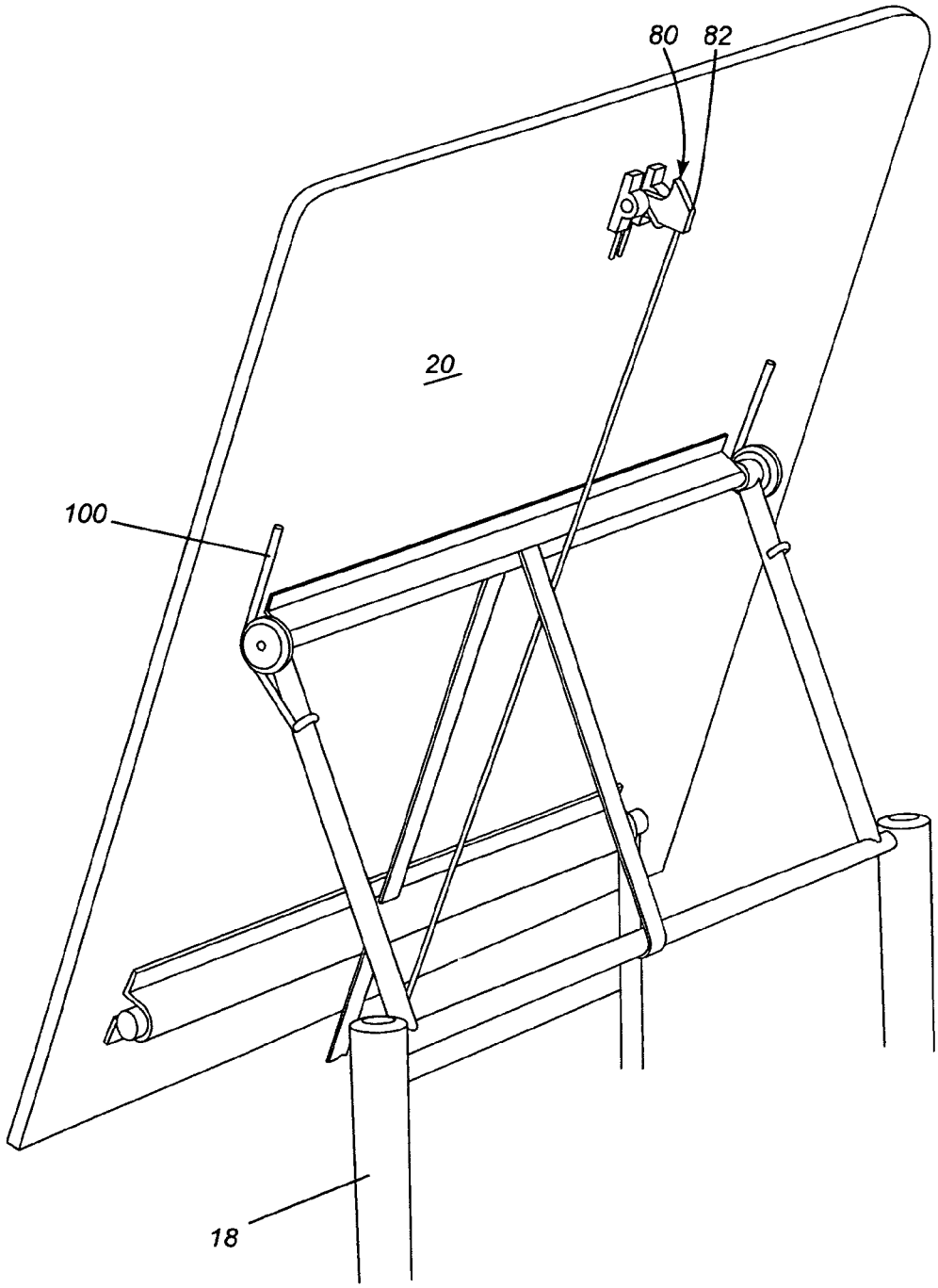
FIG. 8, in a perspective view, illustrates a lock for locking the folding bed of FIG. 1 with the first and second supporting sections thereof in the extended configuration, the first and second supporting sections being in the extended configuration.

As illustrated in FIG. 8, in some embodiments of the invention, the folding bed 10 includes a releasable lock 80 for locking the first and second supporting sections 20 and 26 in the extended configuration. The lock 80 is operable between a locked configuration and an unlocked configuration. In the locked configuration, illustrated in FIG. 11A, the lock 80 locks the first and second supporting sections 20 and 26 in the extended configuration. In the unlocked configuration, as shown in FIG. 11C, the lock 80 allows the first and second supporting sections 20 and 26 to move between the extended configuration and the bent configuration.

Figure 11A:
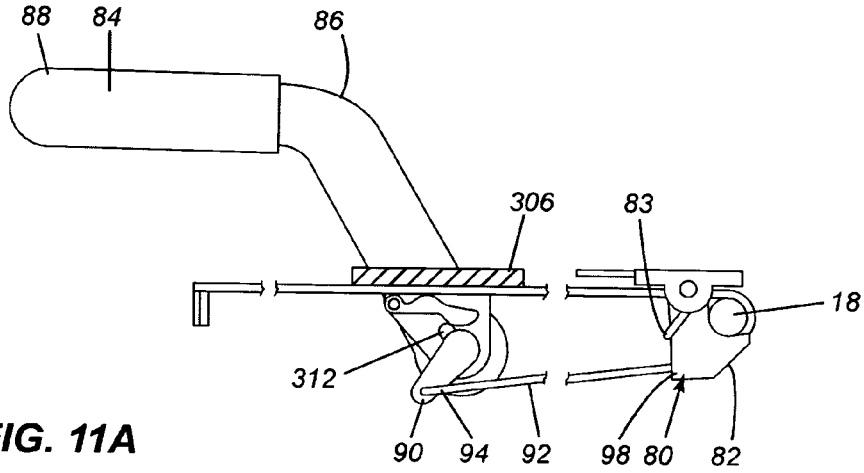
FIGS. 11A, 11B, and 11C illustrate, in a side elevation view, the operation of the actuator of FIG. 10 to unlock and block the lock of FIG. 9.
Figure 11B:
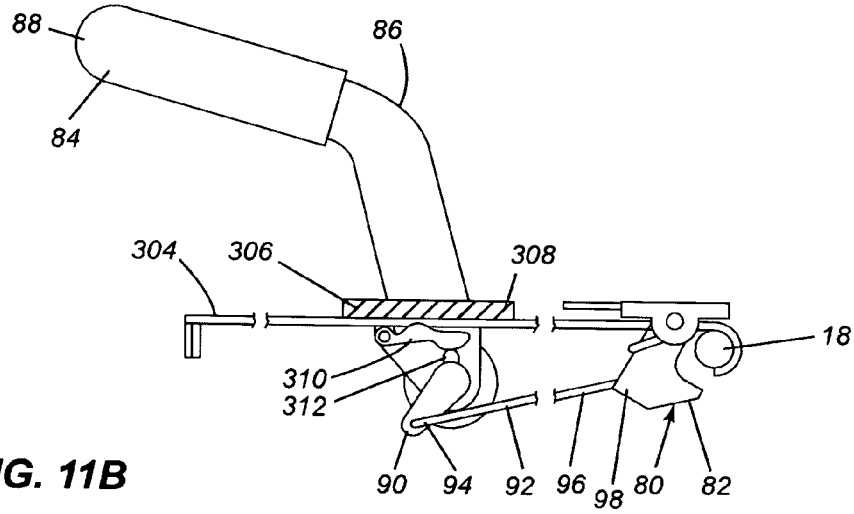
Figure 11C:
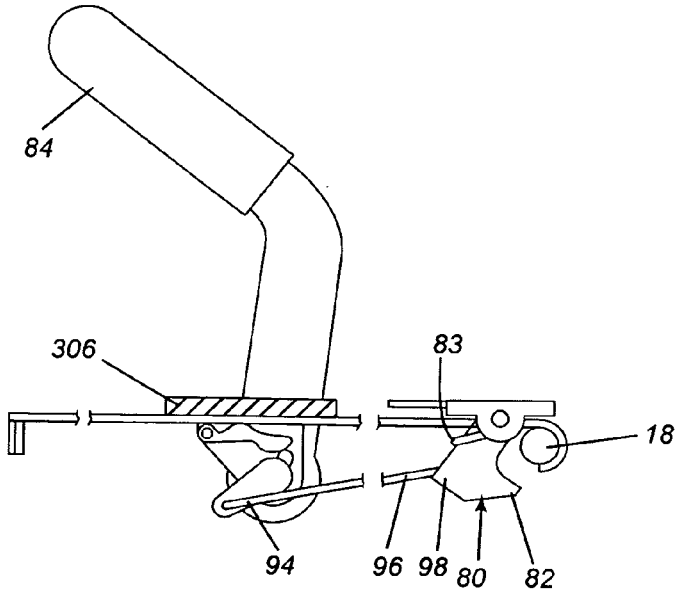

Referring to FIGS. 11A, 11B and 11C, the lock 80 includes a locking member 82 pivotally linked to the first supporting member 20 (not shown in FIGS. 11A-11C) to be operable between a pivotal locked position and a pivotal unlocked position. The locking member 82 is in the pivotal locked position when the lock 80 is in the locked configuration. The locking member 82 is in the pivotal unlocked position when the lock is in the unlocked configuration.

The locking member 82 secures the first supporting member 20 to the frame base 18 when the first and second supporting sections 20 and 26 are in the extended configuration. The locking member 82 allows the first supporting section 20 to move with respect to the frame base 18 when the locking member 82 is in the pivotal unlocked position.

The lock 80 further includes a lock actuator 84. The lock actuator 84 is operatively coupled to the locking member 82. The lock actuator 84 allows the intended user 350 to operate the locking member 82 between the pivotal locked and unlocked configurations. The lock actuator 84 is linked to the locking member 82 through a cable 92, the cable 92 defining a cable first end 94 and a longitudinally opposed cable second end 96.

The lock actuator 84 includes a handle 86 pivotally attached to the second supporting member 26, as seen for example in FIG. 5. Returning to FIGS. 11A, 11B and 11C, the handle 86 includes a grasping section 88 graspable by the intended user 350 and a substantially opposed cable attachment portion 90. The cable attachment portion 90 receives the cable first end 94. The cable second end 96 is secured to the locking member 82 at an attachment point 98. The attachment point 98 is located so that the cable 92 extends substantially outwardly from the locking member 82 in a direction causing the cable 92 to have a substantially non-zero leverage with respect to the location of the locking member 82 about which the locking member 82 pivots.

In some embodiments of the invention, the locking member 82 is biased towards the locked configuration by a lock biasing element 83. The lock biasing element 83 is any suitable biasing element.

Figure 9:
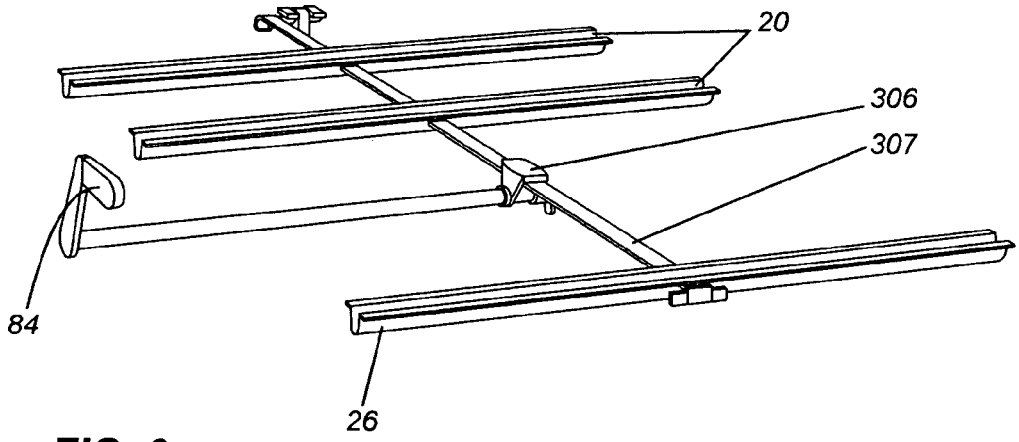
FIG. 9, in a perspective view, illustrates an actuator for operating the lock of FIG. 8, the first and second supporting sections being in the extended configuration.
Figure 10:
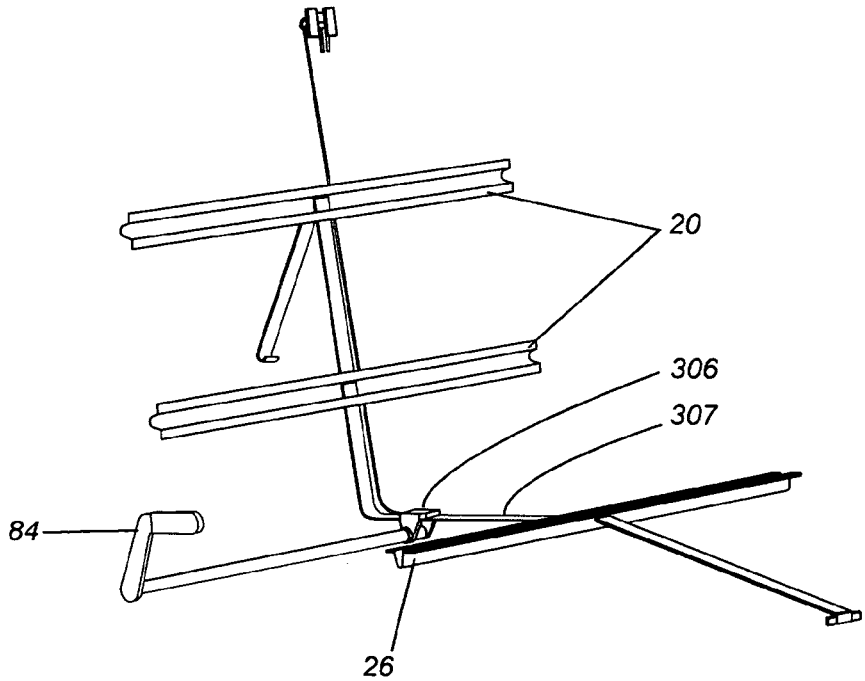
FIG. 10, in a perspective view, illustrates the actuator of FIG. 9 with the first and second supporting sections in the bent configuration.

As seen in FIGS. 9 and 10, the first and second supporting sections 20 and 26 (which are only partially shown in FIGS. 9 and 10) are slidably mounted to a substantially flexible band 304 itself secured to the bed frame 16 (not shown in FIGS. 9 and 10) at both ends thereof. In addition, the lock actuator 84 is also slidably mounted to the flexible band 304 through an actuator-to-band mounting member 306. When the first and second supporting sections 20 and 26 are moved between the extended and bent configurations, the first and second supporting sections 20 and the actuator-to-band mounting member 306 slide onto the flexible band 304.

Referring to FIG. 11B, in some embodiments of the invention, the lock 80 is operable to a blocking configuration wherein the lock 80 blocks a pivotal movement between the first and second supporting sections 20 and 26. In these embodiments of the invention, the actuator-to-band mounting member 306 allows to block the first and second supporting sections 20 and 26 in a configuration intermediate the extended and bent configurations. However, in alternative embodiments of the invention, the actuator-to-band mounting member 306 is any other suitable mounting member and does not necessarily allow blocking the folding bed in a configuration intermediate the extended and bent configurations The actuator-to-band mounting member 306 includes a mounting member body 308 to which the handle 86 is pivotally mounted. In addition, a latch 310 is pivotally mounted to the mounting member body 308 at a location substantially adjacent the flexible band 304. The handle 86 includes a latch actuator 312 abutting against the latch 310.

Upon the handle 86 reaching a blocking position, the latch actuator 312 pushes the latch 310 towards the flexible band 304. In turn, the latch 310 engages the flexible band 304 so as to press the flexible band 304 between the latch 310 and the actuator-to-band mounting member 306, thereby substantially preventing the actuator-to-band mounting member 306 to slide onto flexible band 304. This in turn prevent the first and second supporting sections 20 and 26 to slide onto flexible band 304 and therefore a blocks the folding bed 10.

As shown in FIG. 8, in some embodiments of the invention, a first section biasing element 100 is provided between the first support member 20 and the frame base 18. The first section biasing element 100 biases the first supporting member 20 so that the first and second supporting sections are biased towards the bent configuration. The first section biasing element 100 facilitates the operation of the first and second supporting sections of folding bed 10 by the intended user 350 between the extended configuration and the bent configuration. For example, and non-limitatively, the first section biasing element 100 is provided between the retaining member 60 and the first supporting section 20 and takes the form of a torsion coil spring.

In some embodiments of the invention, the section pivotal link-to-first support member distance is from about 10% to about 30% of the distance between the first supporting section first and second ends 22 and 24. In a very specific embodiment of the invention, the section pivotal link-to-first support member distance is about 15% of the distance between the first supporting section first and second ends 22 and 24. However, it is within the scope of the invention to have the section pivotal link-to-first support member distance take any other suitable value. Section pivotal link-to-first support member distances comprised within the above mentioned interval have been found to allow the intended user 350 to relatively easily move the first and second supporting sections 20 and 26 between the extended and the bent configurations with the exertion of relatively small force, while allowing to bend the mattress 14 in regions substantially adjacent the first-to-second section pivotal link 32.

In operation, the folding bed 10 is operated by the intended user 350 in the following manner. First, it will be assumed that the first and second supporting sections 20 and 26 are in the elongated configuration, as shown in FIG. 1. Then, the intended user 350 simply lays onto the folding bed 10 as he would on any traditional bed.

To move the first and second supporting sections 20 and 26 towards the bent configuration, the intended user 350 rotates the handle 86 so as to pull onto the cable 92 while ensuring that the latch 310 does not engage the flexible band 304. In turn, this rotates the locking member 82 away from the frame base 18 and therefore frees the first supporting section 20 so that it may pivot with respect to the second supporting section 26. The unlocking of the lock 80 is better shown in FIGS. 11A, 11B and 11C.

To achieve the bent configuration, the intended user 350 lifts the torso 352 from the mattress 14. This shifts the centre of force exerted by the intended user 350 onto the first and second supporting sections 20 and 26. When the center of force of the forces exerted by the intended user 350 onto the first supporting section 20 is suitably shifted towards the first-to-second section pivotal link 32, the first supporting section second end 24 is lowered under the action of gravity and of the biasing element 100, if the latter is present.

Then, the retaining member 60 constrains the movement of the first supporting section 20 so that the wheel 48 rolls onto the rail 46 towards the frame base first end 40. In turn, this causes the second support member second end 54 to be translated towards the frame base first end 40.

Simultaneously, the first-to-second section pivotal link 32 and the hinges 81 ensure that the second supporting section second segment 78 pivots with respect to the first supporting section 20 and that the second supporting section first and second segments 76 and 78 also pivot with respect to each other.

In the bent configuration, an angle between the first supporting section 20 and the second supporting section 26 is from about 85 to about 90 degrees. However, it is within the scope of the invention to have this angle take any other suitable value.

Furthermore, the second supporting section first and second segments 76 and 78 are also angled with respect to each other so that the knees of the intended user 350 are bent. This increases the comfort of the intended user 350 in the seated configuration.

The retraction of the second supporting section second end 30 towards the frame base first end 40 frees the lid 70. Then, as shown in FIGS. 14 and 15, the lid 70 may be raised and thereafter pivoted with respect to the storage compartment body 68, such that the display device 74 becomes viewable by the intended user 350. This operation is performed, in the folding bed 10, independently from the passage from the extended configuration to the bent configuration.

More specifically, powering the motor 232 rotates the axle 230, which in turn rotates the threaded rod 226. Suitably selecting a direction of rotation for the motor 232 causes the second deployment member first end 210 to be moved towards the first deployment member first end 206. In this phase of deployment, the first deployment member second end 208 moves substantially parallel to the threaded rod 226 because of constraints caused by the first and second guiding grooves 218 and 220.

Upon the junction between the third deployment member first and second segments 214 and 216 reaching the first guiding groove second segment 224, the third deployment member 205 pivots with respect the lid 70 and forces the latter to rotate towards the open configuration.

When the intended user 350 wishes to pass from the bent configuration to the extended configuration, the above-described steps are reversed.

Figure 12:
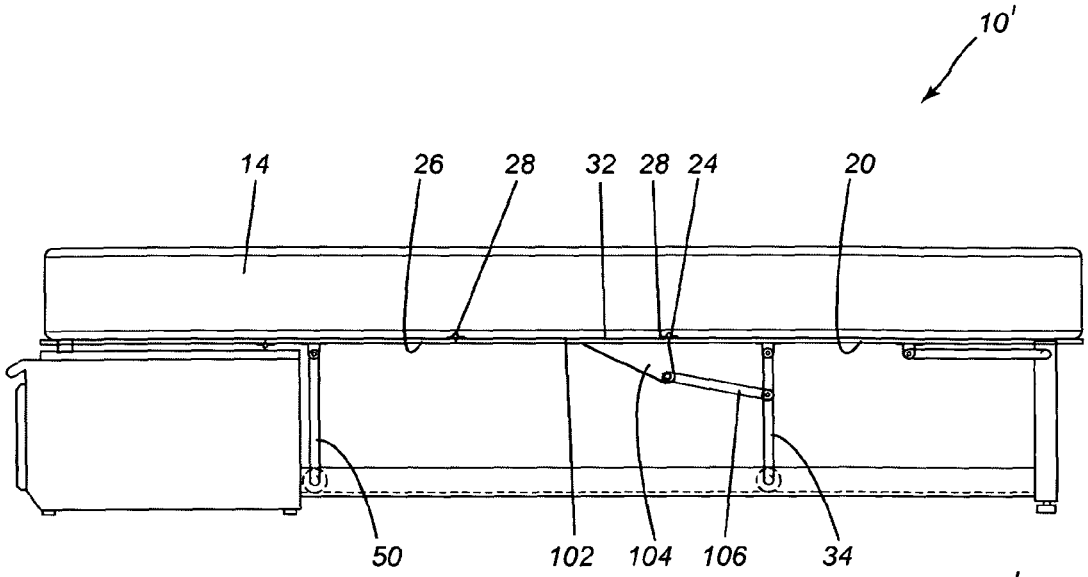
FIGS. 12 and 13, in a side elevation view, illustrate a folding bed in accordance with an alternative embodiment of the present invention the first and second supporting sections thereof being respectively in an elongated configuration and in a bent configuration.
Figure 13:
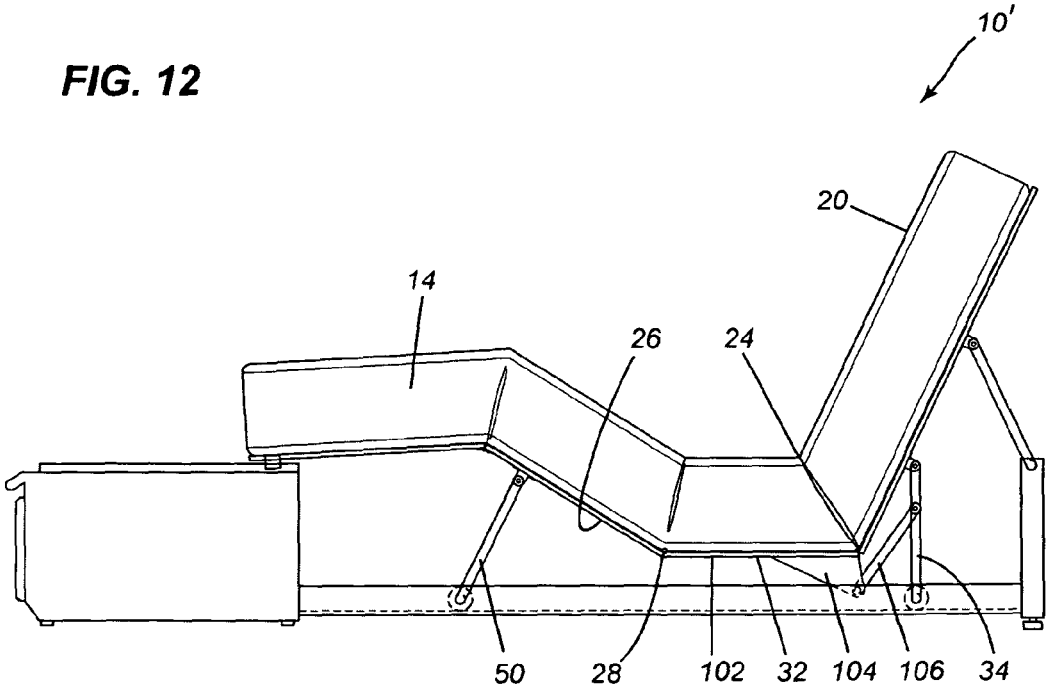

FIGS. 12 and 13 illustrate an alternative bed 10' similar to the folding bed 10. In the bed 10', the first-to-second section pivotal link 32 includes a substantially planar first-to-second section pivotal member 102. The first-to-second section pivotal member 102 is hinged to the second supporting section 26 at a location substantially adjacent the second supporting section first end 28. The first-to-second section pivotal member 102 is further hinged to the first supporting section 20 at a location substantially adjacent the first supporting section second end 24.

In some embodiments of the invention, a pivotal member extension 104 is pivotally linked to a pivot-to-first support member 106, the pivotal member extension 104 extending substantially outwardly and downwardly from the first-to-second section pivotal member 102. The pivot-to-first support member 106 is also pivotally linked to the first support member 34. The pivot-to-first support member 106 insures that the movement of the first-to-second section pivotal member 102 with respect to the first and second supporting sections 20 and 26 is uniquely determined through the imposition of geometric constraints between a level at which the first-to-second section pivotal member 102 is found and a pivotal member-to-first supporting section angle between the first-to-second section pivotal member 102 and the first supporting section 20.

In this embodiment of the invention, the mattress 14 supported by the first and second supporting sections 20 and 26 is maximally bent with an angle substantially smaller than an angle to which the mattress 14 is maximally bent in the folding bed 10. This facilitates the passage to the bent configuration. In some embodiments of the invention, this passage is facilitated enough that no biasing element is required for biasing the first and second supporting sections of the folding bed 10' towards the bent configuration.

In some embodiments of the invention, the pivotal member-to-first supporting section angle between the first-to-second section pivotal member 102 and the first supporting section 20 in the bent configuration is from about 55 degrees to about 80 degrees and, in a very specific embodiment of the invention, this angle is about 65 degrees. These angles have been found to allow the use of relative thick and relatively firm mattresses while allowing to achieve the bent configuration without necessarily requiring the use of biasing elements, such as the biasing element 83.

Figure 18:
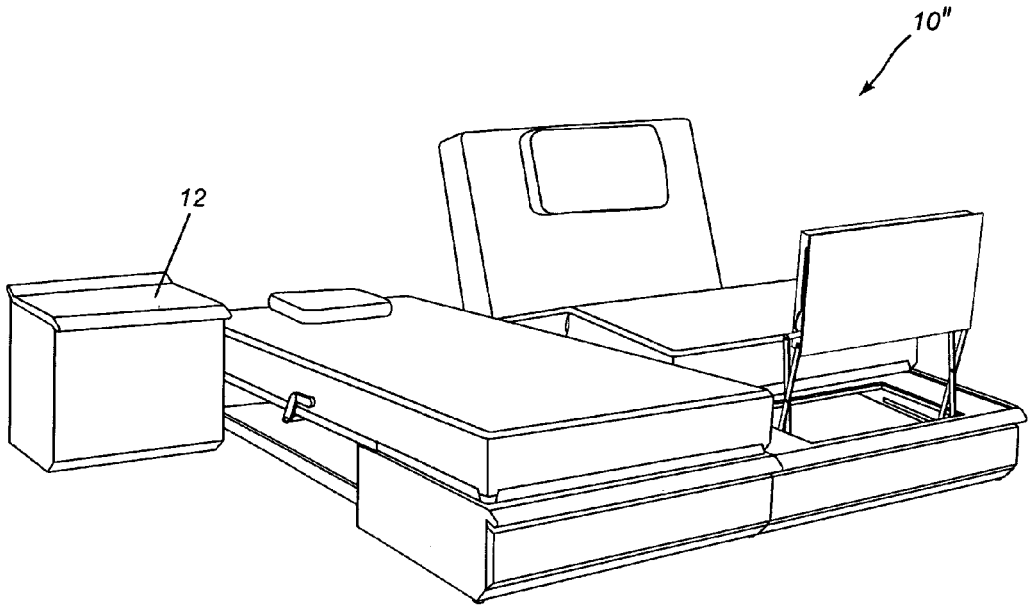
FIG. 18, in a perspective view, illustrates a folding double bed in accordance with another alternative embodiment of the present invention.

FIG. 18 illustrates yet another bed 10" wherein two beds similar to the folding bed 10 are positioned side by side to form a double bed. Accordingly, the bed 10" may be used by two intended users 350, each of the intended users 350 being able to achieve separately the elongated and seated configurations.

Figure 19:
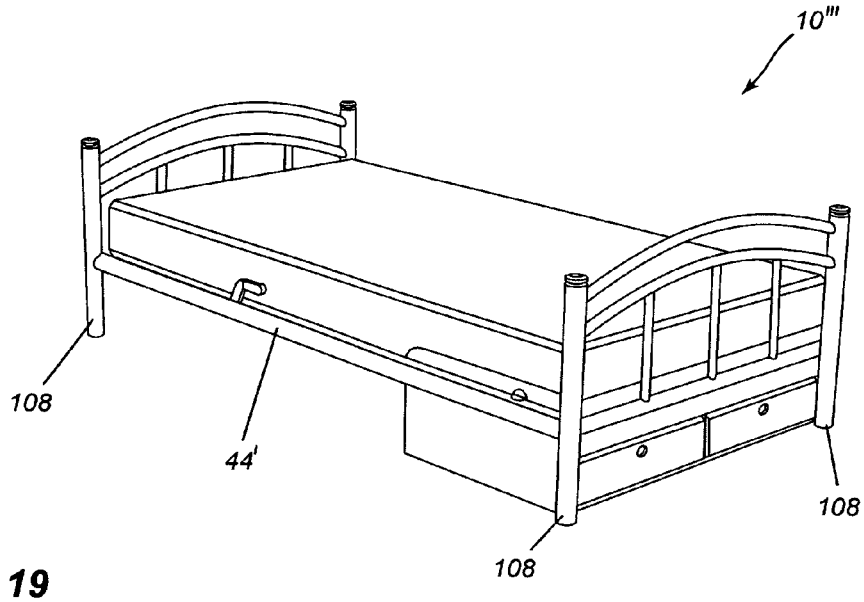
FIGS. 19 and 20, in a perspective view, illustrate a folding bed in accordance with yet another alternative embodiment of the present invention, the folding bed being respectively illustrated with the first and second supporting sections thereof in an extended configuration and in a bent configuration.
Figure 20:
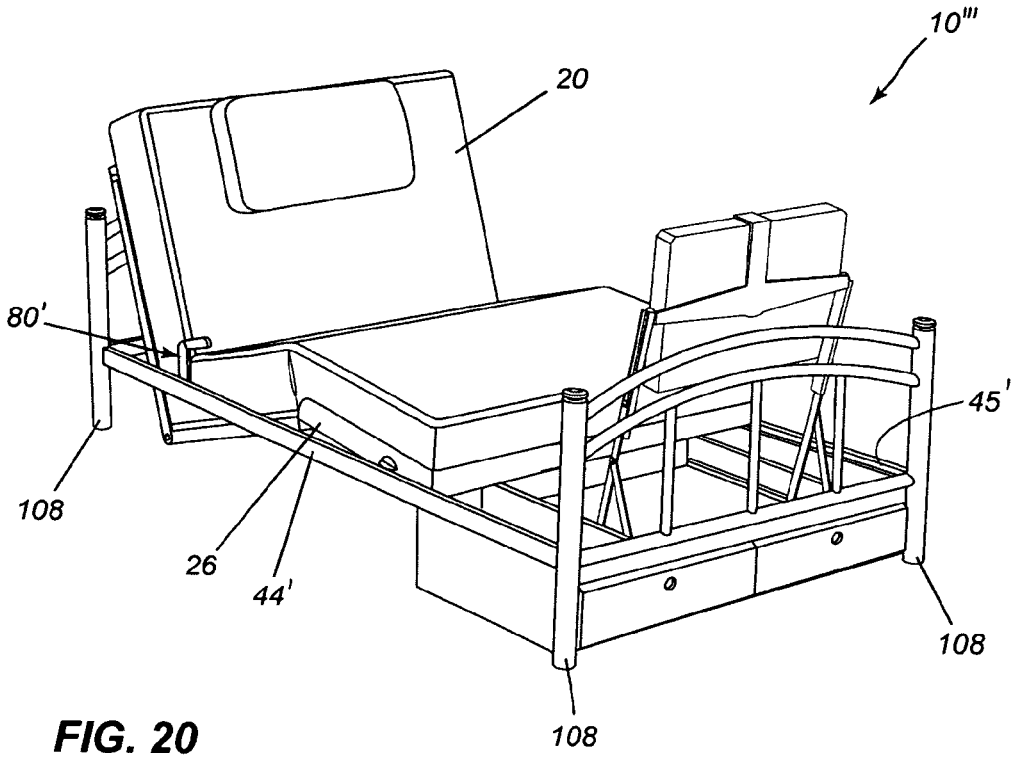
Figure 23:
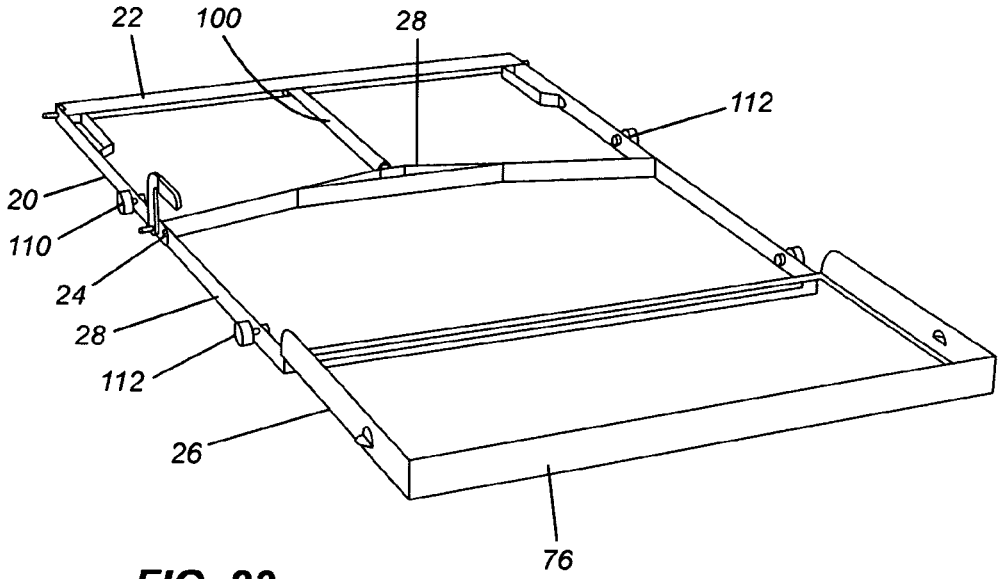
FIGS. 23 and 24, in perspective views, illustrate supporting sections of the bed of FIG. 19, the supporting sections being respectively illustrated in the extended configuration and in the bent configuration.
Figure 24:
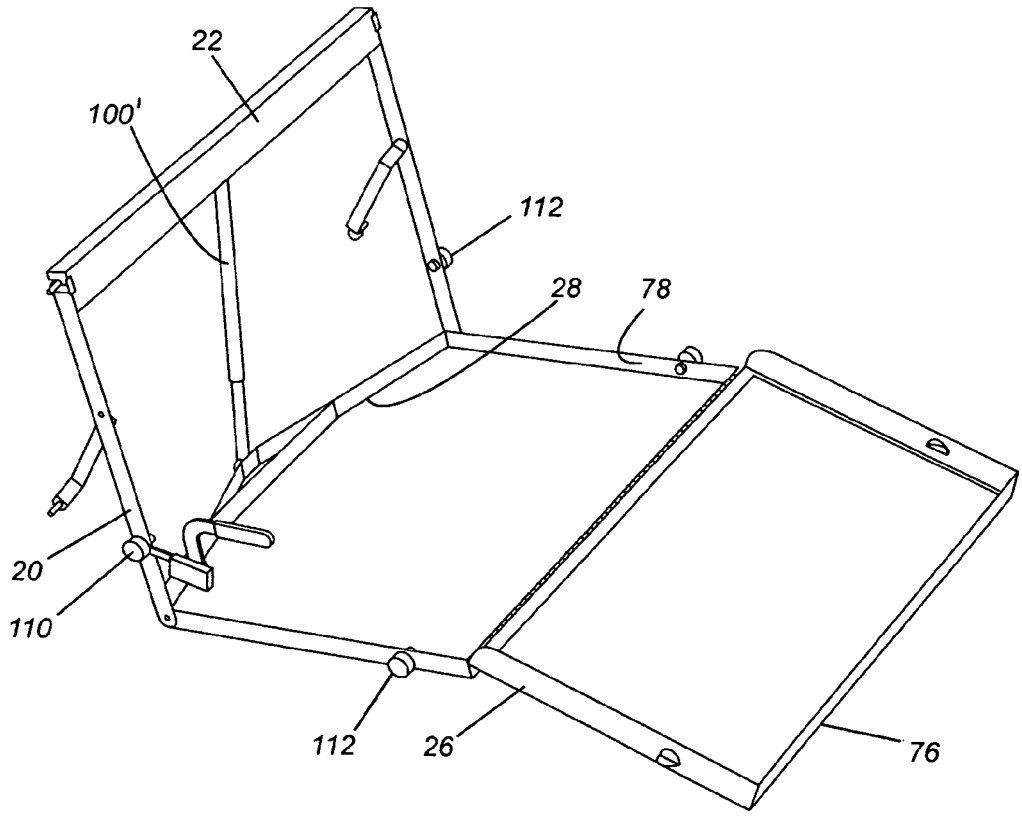

FIGS. 19 and 20 illustrate another alternative bed 10''' respectively with first and second supporting sections 20 and 26 thereof in an extended configuration and in a bent configuration. In the bed 10''', base guiding members 44' and 45' similar to the base guiding members 44 and 45 are supported in spaced relationship relative to a ground surface by four legs 108 (only 3 of which are visible in FIGS. 19 and 20) provided pair wise substantially adjacent the first and second base guiding members 44' and 45' ends. In the bed 10''', as better shown in FIGS. 23 and 24, the first support member takes the form of a support wheel 110 received within the base guiding member 44' (not shown in FIGS. 23 and 24). Similarly, the second support member also takes the form of a guiding wheel 112 received within the base guiding member 45' (not shown in FIGS. 23 and 24). In this embodiment of the invention, the second supporting section second segment 78 is supported by the base guiding member 44' instead of being supported by a storage compartment body 68.

Figure 21:
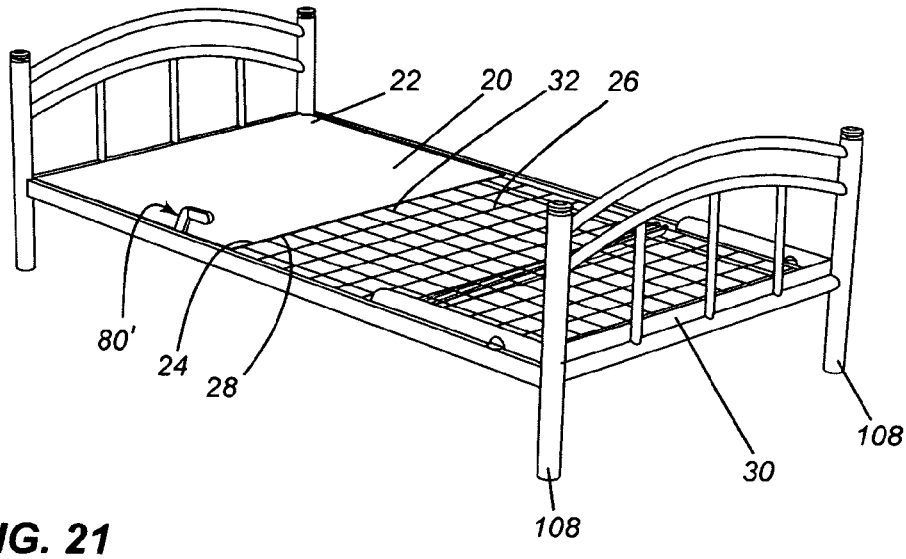
FIGS. 21 and 22, in a perspective view, illustrate the bed of FIG. 19 with the first and second supporting sections thereof respectively in the extended configuration and the bent configuration with a mattress thereof removed.
Figure 22:
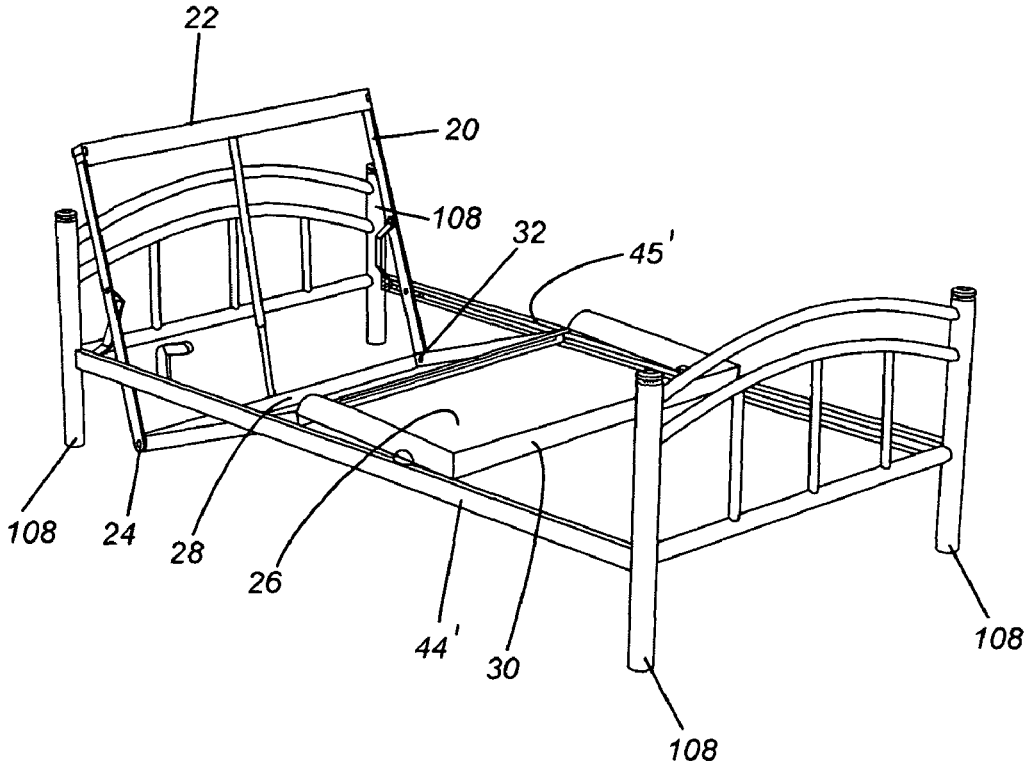

As seen in FIGS. 21 and 22, in the bent configuration, the first-to-second section pivotal link 32 is substantially lower than the base guiding member 44'. This is made possible by the fact that the base guiding members 44' and 45' are supported in spaced relationship relative to the ground by the legs 108.

In some embodiments of the invention, the folding bed 10''' includes a biasing element 100' (seen for example in FIG. 22) provided between the first supporting section first end 22 and the second supporting section first end 28. The biasing element 100' is pivotally linked to the second supporting section first end 28.

The second supporting section 26 is configured such that the second supporting section first end 28 is substantially eccentric with respect to the first-to-second section pivotal link 32. Then, the biasing element 100' biases the first and second supporting sections of the folding bed 10''' towards the bent configuration. An example of a suitable biasing element 100' includes a compression coil spring provided within a telescopic spring housing.

Figure 25A:
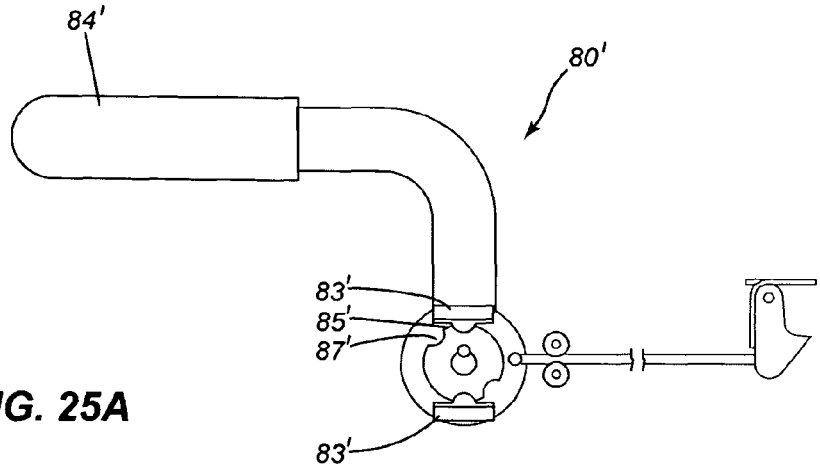
FIGS. 25A, 25B, and 25C, in side elevation views, illustrate the operation of an alternative lock and of an alternative actuator for locking the first and second supporting sections of the bed of FIG. 19 in the extended configuration.
Figure 25B:
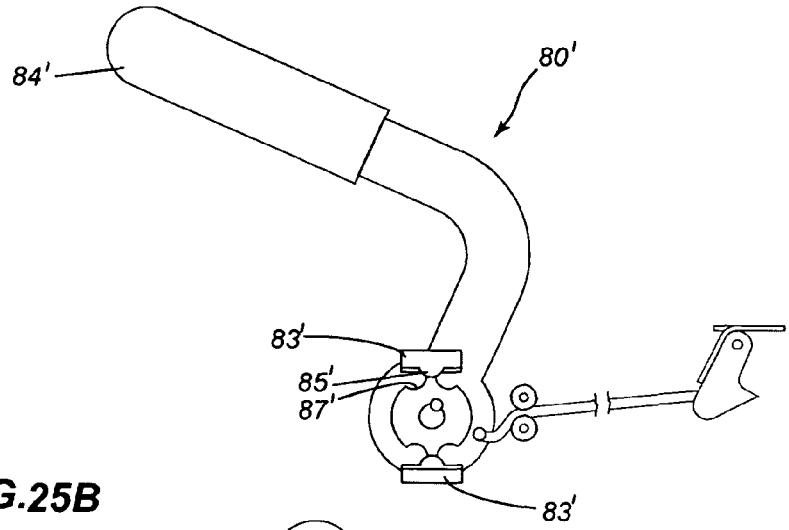
Figure 25C:
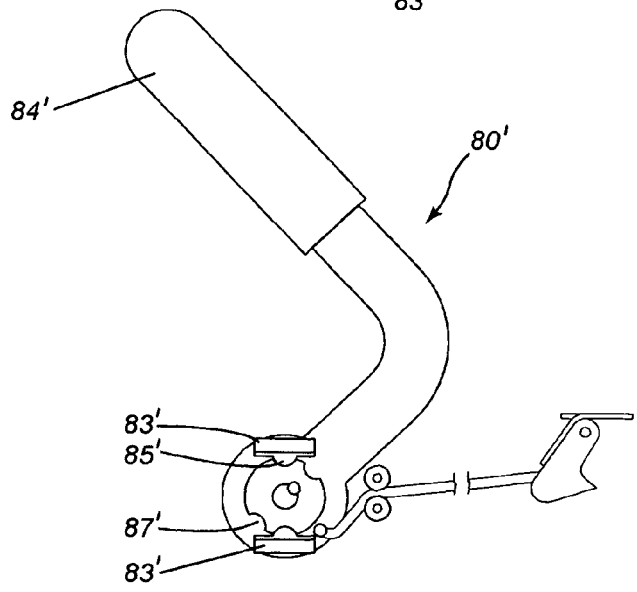

FIGS. 25A, 25B and 25C illustrate the operation of an alternative lock 80' similar to the lock 80. The lock 80' includes a handle 84' pivotally mounted within the base guiding member 44' (not shown in FIGS. 25A, 25B and 25C) and pivotally linked to the first supporting section 20. The handle 84' is similar to the handle 86 except that blocking members 83' are provided to maintain the lock 80' in a blocked configuration. For example, and non-limitatively, the blocking members 83' include bumps 85' that engage suitable grooves 87 in the handle 84'.

When the bumps 85' engage the grooves 87', the blocking members 83' are retracted towards the handle 84'. When the bumps 85' do not engage the bumps 85', the blocking members 83' are biased towards and engage the base guiding member 44', thereby blocking a translational movement of the handle 84' with respect to the base guiding member 44'. Consequently, the first supporting section 20 becomes fixed with respect to the base guiding member 44' and the folding bed 10''' is substantially prevented from changing configuration. Methods and devices for blocking a handle at a predetermined position are well-known in the art and will therefore not be described in further details herein.

Figure 26:
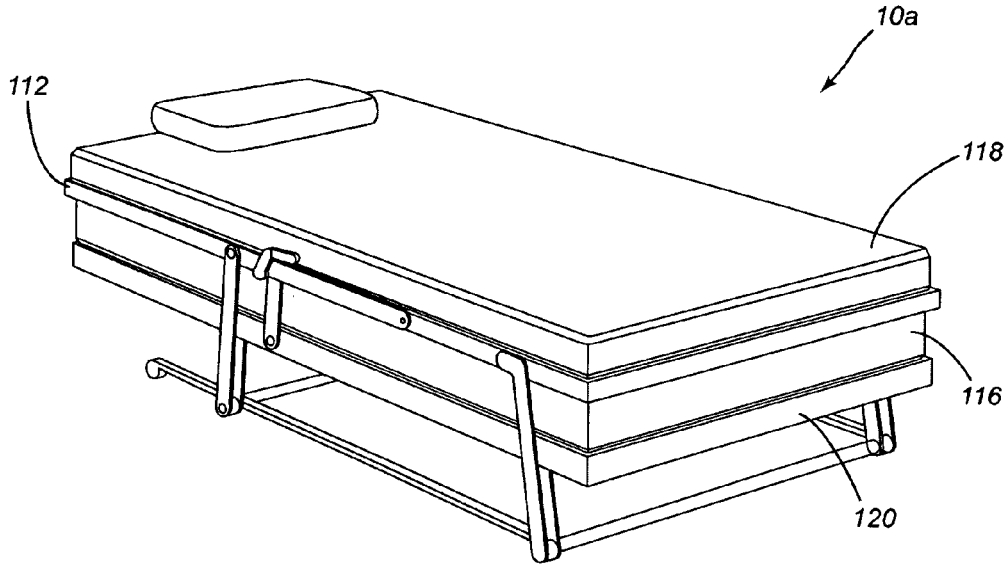
FIGS. 26 and 27, in a perspective view, illustrate a folding bed in accordance with yet another embodiment of the present invention, the folding bed being shown respectively with the first and second supporting sections thereof in an extended configuration and in a bent configuration.
Figure 27:
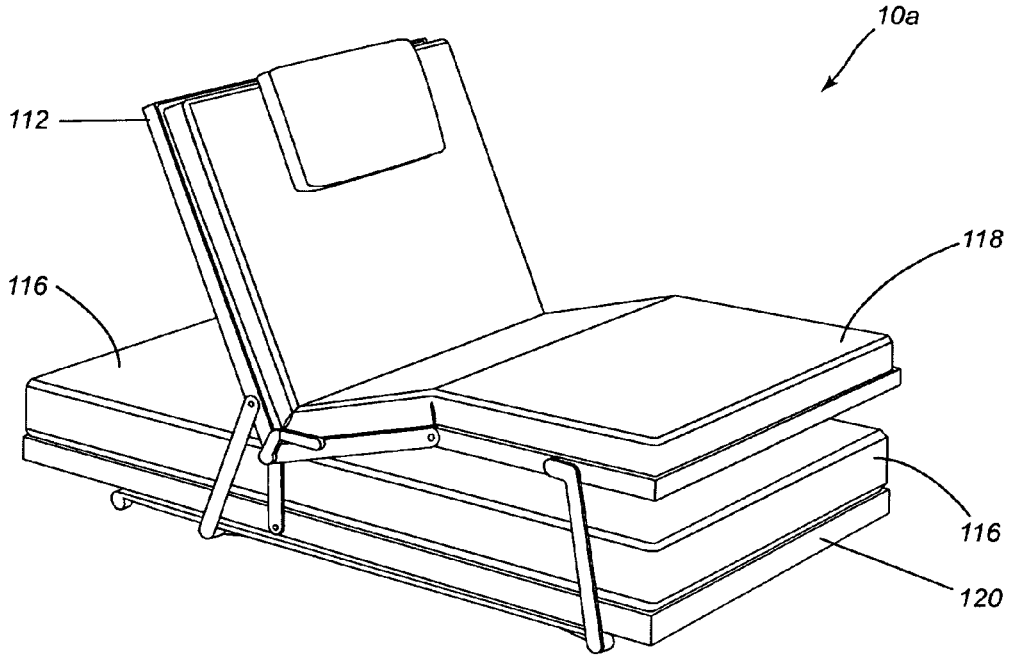

FIGS. 26 and 27 illustrate yet another alternative folding bed 10*a*. The folding bed 10*a* is such that the first and second supporting sections form a peripheral frame 112, as better seen in FIGS. 28 and 29. A substantially resilient upper mattress support 114 extends substantially inwardly from the peripheral frame 112. A non-limitative example of an upper mattress support 114 suitable for use with the present invention is a piece of fabric secured to the peripheral frame 112.

Returning to FIGS. 26 and 27, the folding bed 10*a* includes a lower mattress 116 and an upper mattress 118. Furthermore, the folding bed 10*a* includes a substantially flat lower mattress support 120 for supporting the lower mattress 116. The upper mattress 118 is provided above the lower mattress 116.

The lower mattress support 120 is linked to the peripheral frame 112 so that, in the extended configuration, the lower mattress 116 supports the upper mattress 118 with the upper mattress support 114 being located untensioned between the upper and lower mattresses 116 and 118. In the bent configuration, the lower mattress 120 is in spaced relationship relative to the upper mattress support 114, which causes the upper mattress 118 to be supported by the upper mattress support 114.

Typically, but not necessarily, the lower mattress 116 is relatively thick and relatively rigid. Also, typically, but not necessarily, the upper mattress 118 is relatively thin and relatively flexible. Therefore, in the elongated configuration, the lower mattress 116 supports the upper mattress 118, giving the impression to the intended user 350 of being elongated on a relatively thick and relatively firm mattress. However, when in the first and second supporting sections 20*a* and 26*a* of the folding bed 10*a* is in the bent configuration, the lower mattress 120 no longer supports the upper mattress 118 which bends relatively easy to achieve the bent configuration because of its relatively small thickness and its relatively high flexibility.

Figure 32:
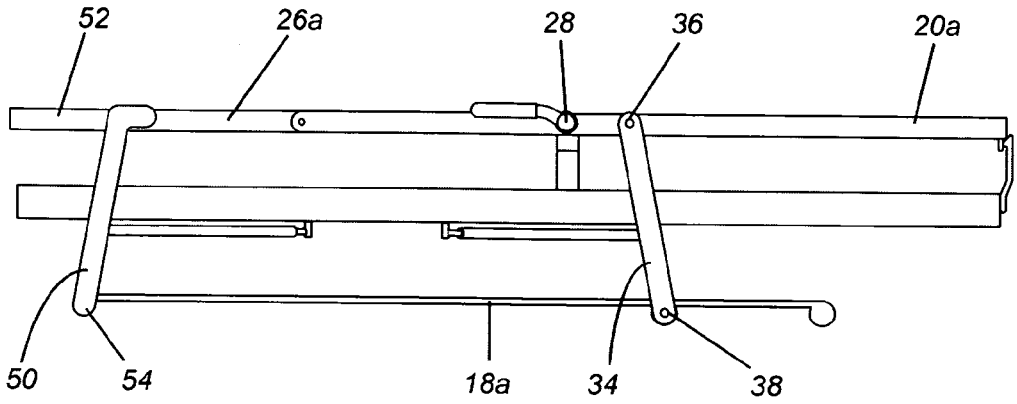
FIGS. 32 and 33, in a side elevation view, illustrate the folding bed of FIG. 26 with a mattress thereof removed, the folding bed being shown respectively with the first and second supporting sections thereof in the extended configuration and in the bent configuration.
Figure 33:
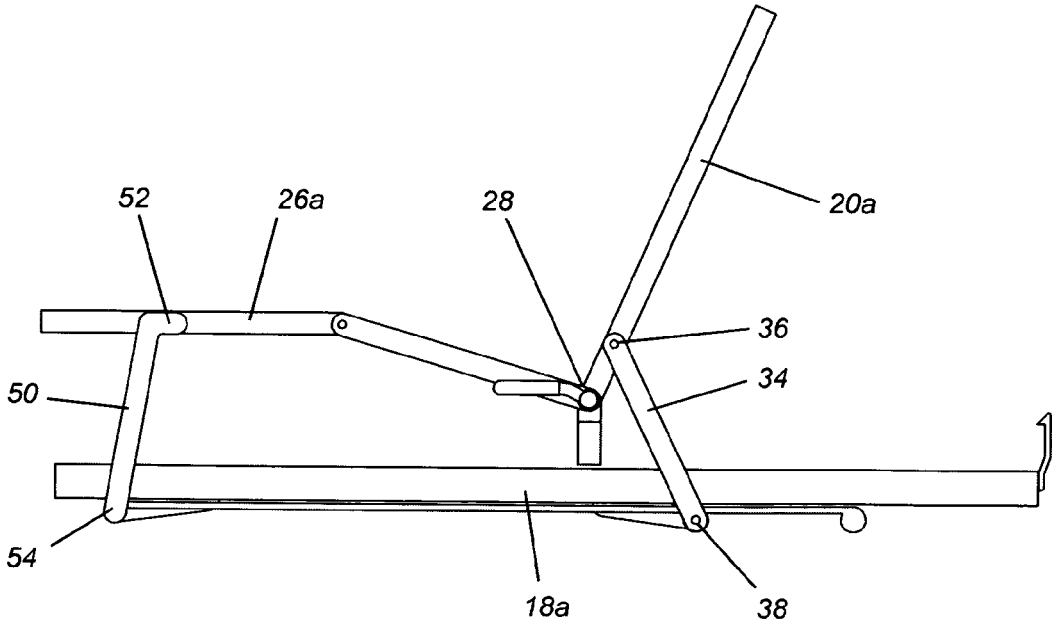

In the bed 10*a*, as better seen in FIGS. 32 and 33, alternative first and second supporting sections 20*a* and 26*a* are secured to an alternative frame base 18*a*. The first and second supporting sections 20*a* and 26*a* and the frame base 18*a* are similar to the first and second supporting sections 20 and 26 and to the frame base 18. However, the first support member second end 38 is pivotally linked to the frame base 18*a*, while the second support member second end 54 is fixed with respect to frame base 18*a*. In addition, the second support member first end 52 is fixed with respect to the second supporting section 26*a*. The first support member first end 36 is pivotally linked to the first supporting section 20*a*. Therefore, in this embodiment of the invention, the distance between the first and second support member second ends 38 and 54 is fixed through their operative coupling to the frame base 18*a*.

Figure 28:
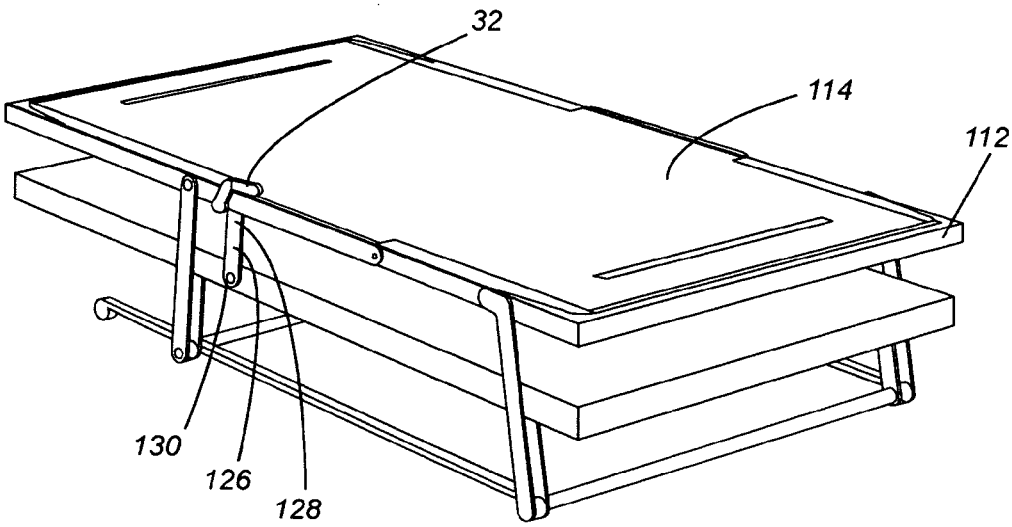
FIGS. 28 and 29, in a perspective view, illustrate the folding bed of FIG. 26 with a mattress thereof removed, the folding bed being shown respectively the with first and second supporting sections thereof in the extended configuration and in the bent configuration.
Figure 29:
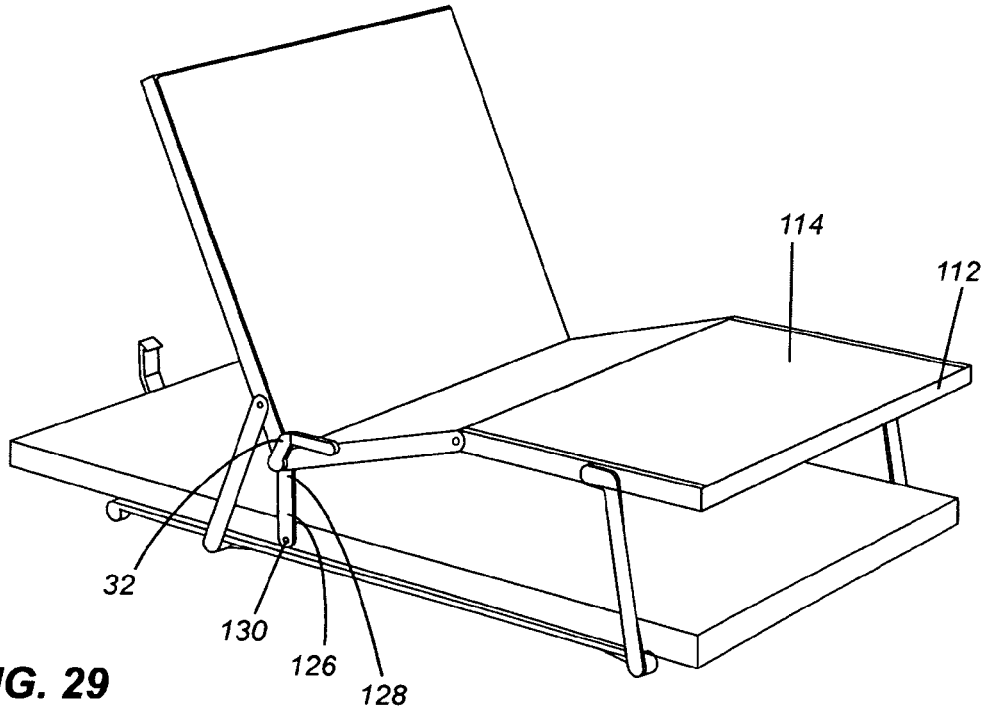

As shown in FIGS. 28 and 29, a spacing member 126 defining a spacing member first end 128 and a spacing member second end 130 longitudinally opposed to the spacing member first end 128 spaces apart the lower mattress support 120 from the upper mattress support 114. The spacing member second end 130 is secured to the lower mattress support 120, while the spacing member first end 128 is secured to the first-to-second section pivotal link 32.

Figure 30:
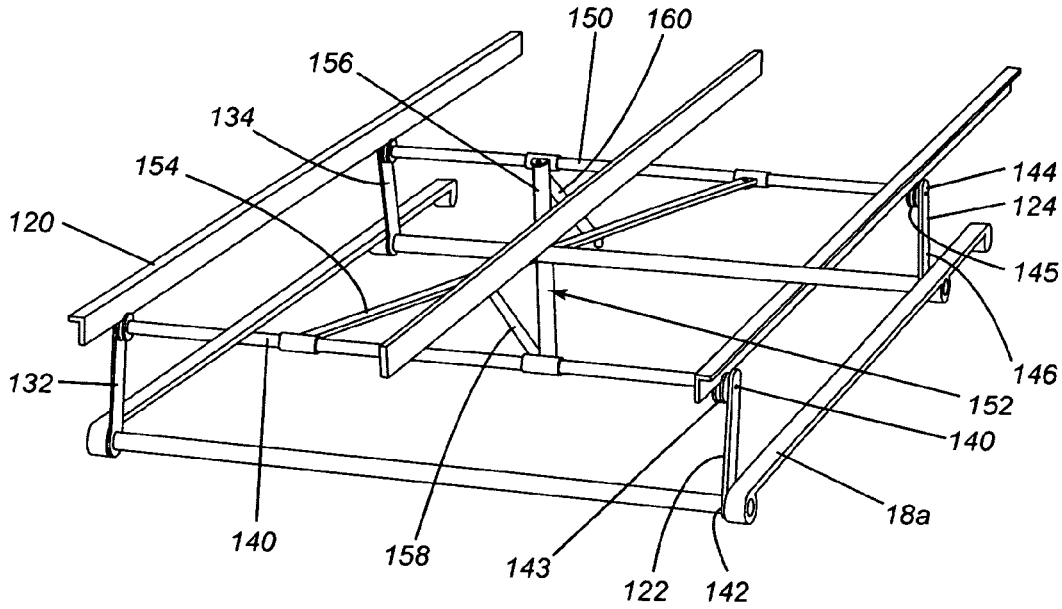
FIGS. 30 and 31, in a perspective view, illustrate a lower mattress support of the folding bed of FIG. 26 with the folding bed respectively with the first and second supporting sections thereof in the extended configuration and in the bent configuration.
Figure 31:
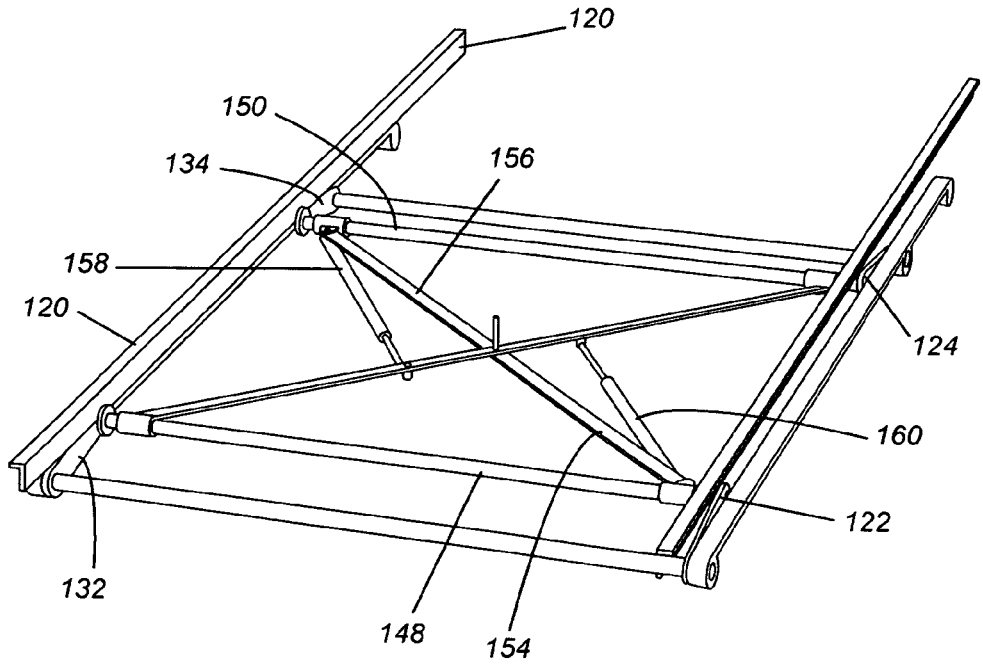

As better shown in FIGS. 30 and 31, the lower mattress support 120 is supported by first and second legs 122, and 124. The first leg 122 defines a first leg first end 140 and a substantially longitudinally opposed first leg second end 142. The second leg 124 defines a second leg first end 144 and a substantially longitudinally opposed second leg second end 146.

The first leg second end 142 is pivotally linked to the frame base 18*a* and a wheel 143 is rotatably mounted to the first leg 122 substantially adjacent the first leg first end 140 supports the lower mattress support 120. Similarly, the second leg second end 146 is pivotally linked to the frame base 18*a* and a wheel 145 is rotatably mounted to the second leg 124 substantially adjacent the second leg first end 144 and supports the lower mattress support 120.

When the first and second legs 122 and 124 pivot with respect to the frame base 18*a*, the wheels 143 and 145 allow the first and second leg first ends 140 and 144 to have a translational motion with respect to the lower mattress support 120 while still supporting the lower mattress support 120.

In some embodiments of the invention, the folding bed 10*a* further includes third and fourth legs 132 and 134 that are substantially laterally opposed to the first and second legs 122 and 124. The third and fourth legs 132 and 134 are substantially similar to the first and second legs 122 and 124. The first and third legs 122 and 132 are linked to each other through a first-to-third leg linking member 148 extending therebetween substantially adjacent the lower mattress support 120, which is only shown partially in FIGS. 30 and 31. Similarly, the second and fourth legs 124 and 134 are linked through a second-to-fourth leg linking member 150 extending therebetween substantially adjacent the lower mattress support 120.

A substantially X-shaped interlinking assembly 152 extends between the first-to-third leg linking member 148 and the second-to-fourth leg linking member 150. The interlinking assembly 152 includes first and second arms 154 and 156 that are both slidably mounted at both ends thereof to one of the first-to-third leg linking member 148 and the second-to-fourth leg linking member 150. The first and second arms 154 and 156 are pivotally linked to each other at locations intermediate the ends thereof both to each other and to the lower mattress support 120.

In some embodiments of the invention, but not necessarily, a biasing element 158 interlinks the first and second arms 154 and 156 to bias the lower mattress support so that the first and second supporting sections of the bed 10*a* are biased towards the extended configuration. In some embodiments of the invention, another biasing element 160 also interlinks the first and second arms 154 and 156 to similarly bias the lower mattress support.

When passing from the extended configuration to the bent configuration, the first and second supporting sections 20*a* and 26*a* pivot with respect to each other as in the folding bed 10, except that since no retaining member is provided in the folding bed 10*a*, and since the second support member 50 is fixed with respect to the frame base 18*a* and to the second supporting section 26*a*, the second supporting section 26*a* is not retracted towards the bed frame first end 300.

This causes the first-to-second section pivotal link 32 to be lowered and therefore lowers the lower mattress support 120 with respect to the frame base 18*a*. As the lower mattress support 120 is lowered, the first and second leg first ends 140 and 144 move toward each other and the first and second legs 122 and 124 pivot with respect to the frame base 18*a*. In turn, this increases an angle between the first and second arms 154 and 156.

When passing from the bent to the extended configurations, the above-described steps are reversed. The biasing elements 158 and 160 facilitate this passage from the bent to the extended configurations. However, in alternative embodiments of the invention, the biasing elements 158 and 160 are not present and the lower mattress support 120 is raised by a force exerted by the intended user 350.

Figure 34:
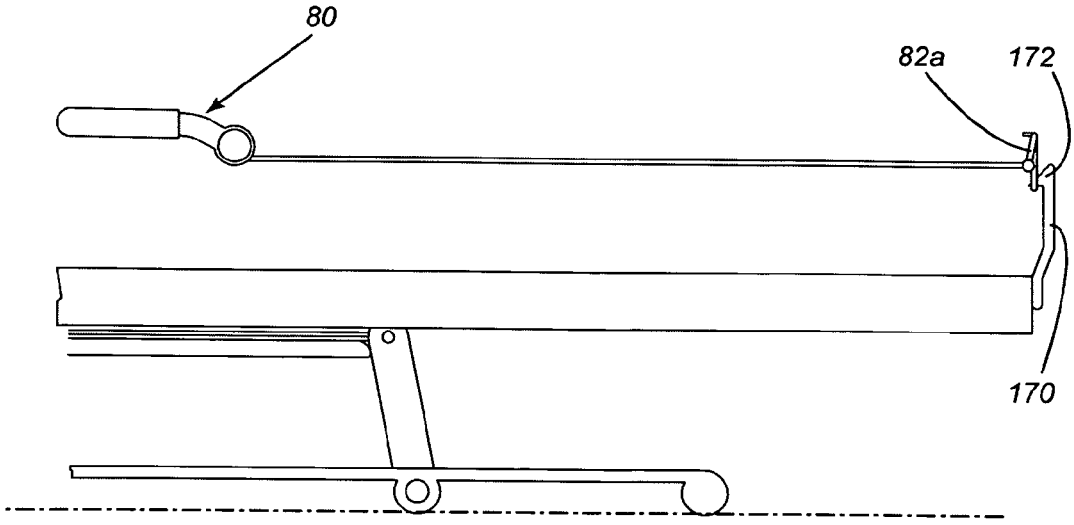
FIGS. 34 and 35, in a side elevation view, illustrate the operation of an alternative lock and of an alternative actuator for locking the bed of FIG. 26 with the first and second supporting sections thereof in the extended configuration.
Figure 35:
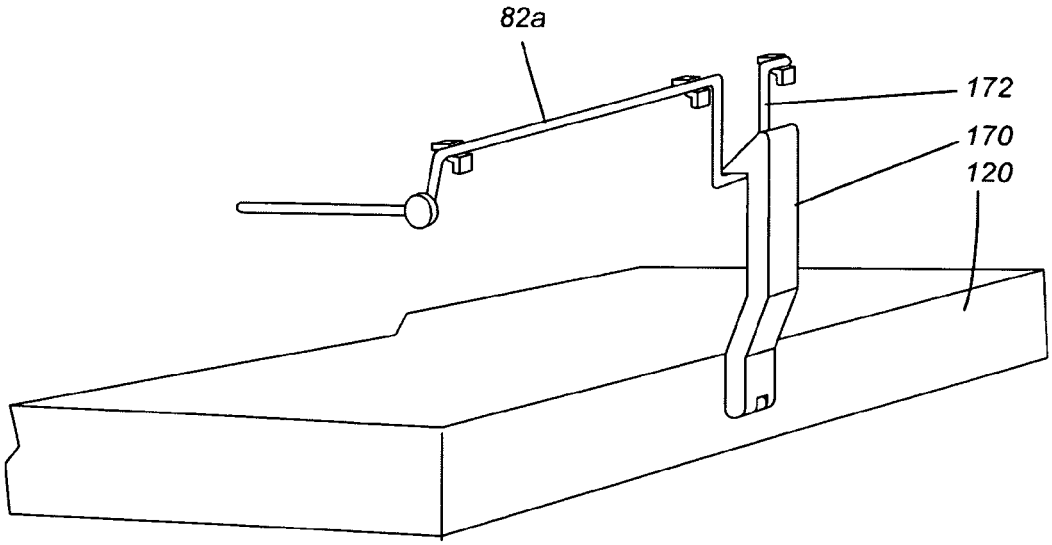

FIGS. 34 and 35 illustrate a lock 80*a* usable with the folding bed 10*a*. The lock 80*a* is similar to the lock 80 except that a locking member 82*a* of the lock 80*a* locks the first and second supporting sections of the folding bed 10*a* in the extended configuration by engaging a locking component 170 extending substantially upwardly from the lower mattress support 120. The locking component 170 includes a hook 172 for engaging a suitably shaped locking member 82*a*.

Figure 36:
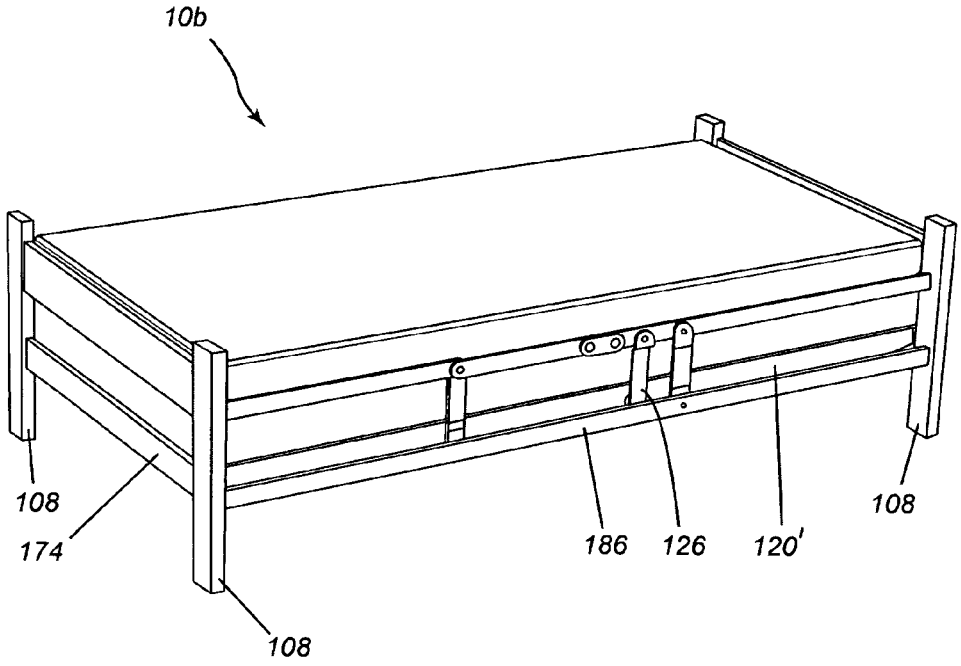
FIGS. 36 and 37, in a perspective view, illustrate a folding bed in accordance with yet another embodiment of the present invention, the folding bed being shown respectively with the first and second supporting sections thereof in an extended configuration and in a bent configuration.
Figure 37:
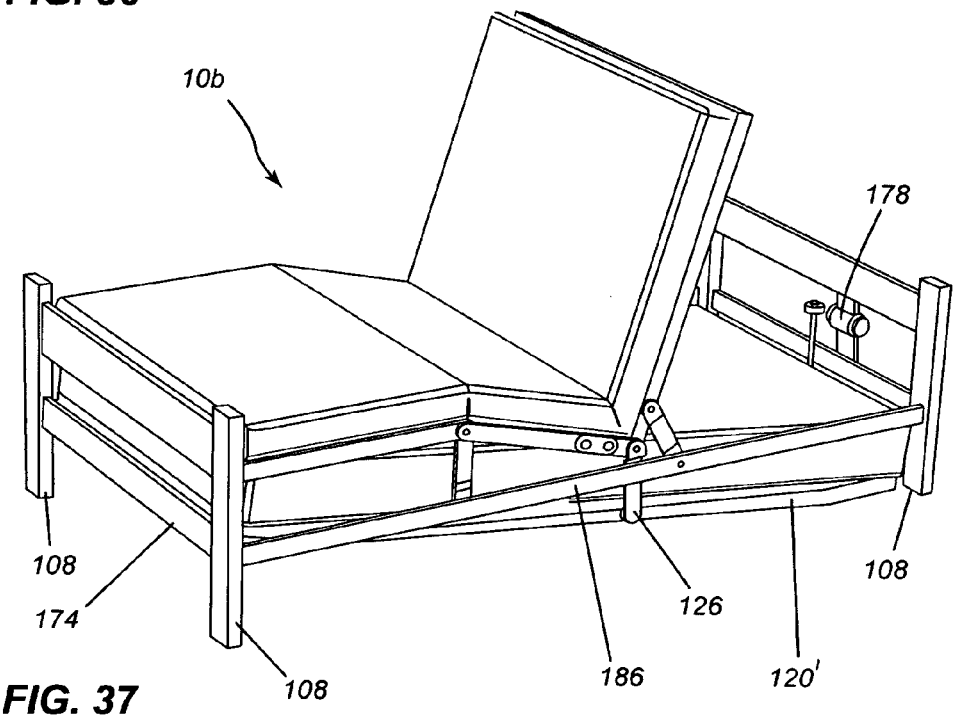
Figure 38:
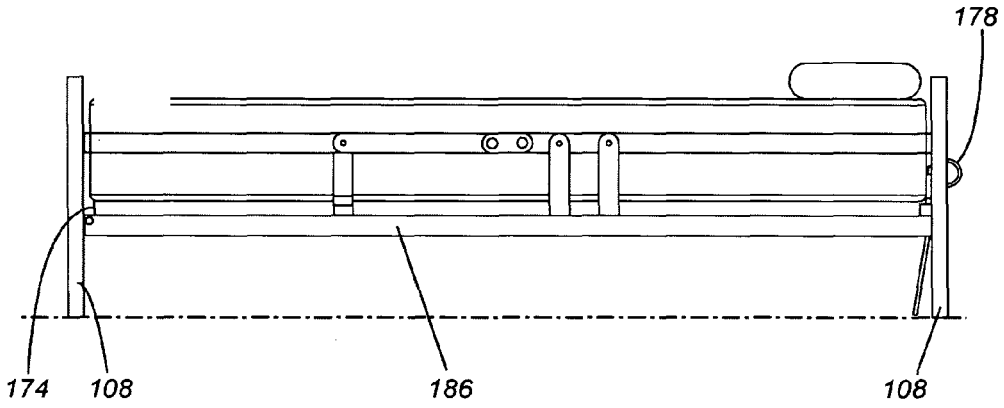
FIGS. 38 and 39, in a side elevation view, illustrate the folding bed of FIG. 36, the folding bed being shown respectively with the first and second supporting sections thereof in the extended configuration and in the bent configuration.
Figure 39:
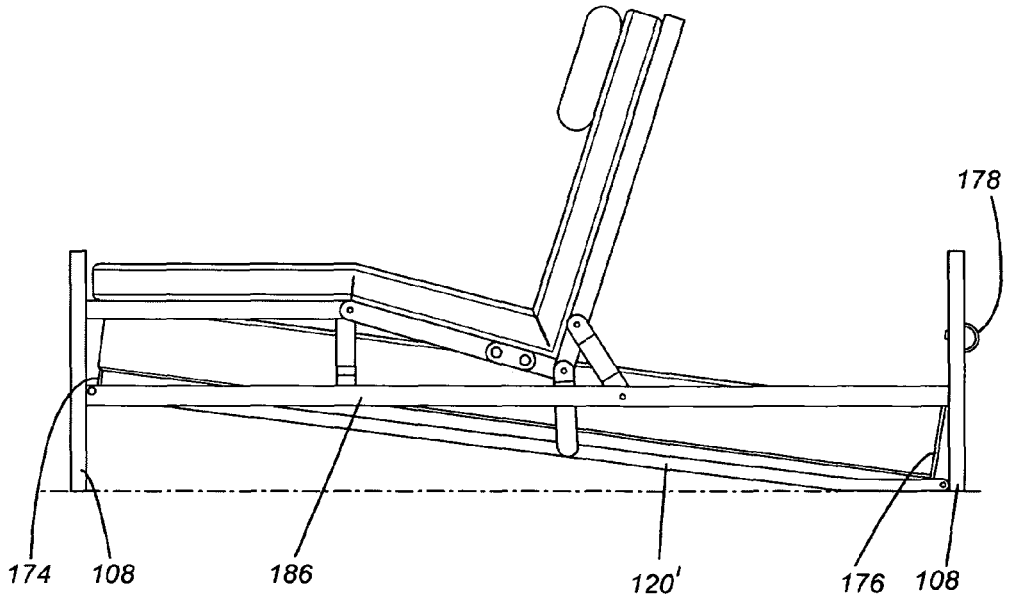

Referring to FIGS. 36 and 37, there is shown another alternative folding bed 10*b* similar to the folding bed 10*a*. However, instead of having a lower mattress support 120 that is lowered when passing from an extended to a bent configuration, the folding bed 10*b* includes an alternative lower mattress support 120' defining a lower mattress support first end 174 and a longitudinally opposed lower mattress support second end 176.

A frame base 18*b* is supported in spaced relationship relative to a ground surface by legs 108. The lower mattress support first end 174 is pivotally linked to the frame base 18*b* substantially adjacent the lower mattress support first end 174. The lower mattress support second end 176 is linked to a suitable actuator 178, such as an actuator including an electric motor, allowing to lower and raise the lower mattress support second end 176 with respect to the frame base 18*b*, thereby allowing the movement of the first and second supporting sections between the extended and the elongated configurations.

Although the present invention has been described hereinabove by way of preferred embodiments thereof, it can be modified, without departing from the spirit and nature of the subject invention as defined in the appended claims.

What is claimed is:

1. A folding bed for supporting an intended user in both an elongated configuration and a seated configuration, said intended user having a torso, a pair of lower limbs and a hip region therebetween, said intended user also having a weight, said folding bed being positionable on a ground surface, said folding bed comprising:

a bed frame having a frame base, said bed frame defining a bed frame first end and a longitudinally opposed bed frame second end;

a first supporting section for supporting said torso, said first supporting section defining a first supporting section first end and a longitudinally opposed first supporting section second end;

a second supporting section for supporting said lower limbs, said second supporting section defining a second supporting section first end and a longitudinally opposed second supporting section second end, said first and second supporting sections being angled relative to each other by a first-to-second section angle;

said first and second supporting sections being pivotally coupled together through a first-to-second section pivotal link for pivotal movement between an elongated configuration and a bent configuration, wherein, in said extended configuration, said first and second supporting sections are in a substantially coplanar relationship with respect to each other, and, in said bent configuration, said first-to-second section angle has a value smaller than 180 degrees;

a first support member defining a first support member first end and a longitudinally opposed first support member second end, said first support member first end being pivotally attached to said first supporting section intermediate said first supporting section first end and said first supporting section second end at a section pivotal link-to-first support member distance from said pivotal link, said first support member second end being mechanically coupled to said frame base;

wherein:

when said first and second supporting sections are in said extended configuration, said first-to-second section pivotal link is at a first level relative to said frame base; and when said first and second supporting sections are in said bent configuration, said first-to-second section pivotal link is at a second level relative to said frame base, said second level being substantially lower than said first level;

said first and second supporting sections being movable by said intended user between said extended and bent configurations with said intended user laying in said bed and moving said torso with respect to said lower limbs to change a torso-to-lower limbs angle between said torso and said lower limbs to shift said weight of said intended user with respect to said folding bed and cause a change in said first-to-second section angle.

2. A folding bed as defined in claim 1, wherein:

said frame base defines a frame base first end and a longitudinally opposed frame base second end; and said frame base includes a substantially longitudinally extending base guiding member, said second supporting section being operatively coupled to said base guiding member to allow a translational movement of said second supporting section towards said frame base first end relative to said base guiding member when said first and second supporting sections are moved from said elongated configuration to said bent configuration.

3. A folding bed as defined in claim 2, wherein said base guiding member includes a rail and said first support member second end includes a wheel, said wheel being operatively mounted to said rail for slidable movement therealong.

4. A folding bed as defined in claim 3, further comprising a second support member defining a second support member first end and a longitudinally opposed second support member second end, said second support member first end being pivotally attached to said second supporting section intermediate said second supporting section first end and said second supporting section second end at a section pivotal link-to-second support member distance from said pivotal link, said second support member second end being operatively coupled to said frame base.

5. A folding bed as defined in claim 4, wherein said second support member second end is operatively coupled to said base guiding member to allow a translational movement of said second support member second end with respect to said base guiding member when said first and second supporting sections are moved between said elongated configuration to said bent configuration.

6. A folding bed as defined in claim 5, wherein said first and second support members are interconnected by a substantially rigid first-to-second support member interconnector.

7. A folding bed as defined in claim 6, wherein said first-to-second support member interconnector is attached respectively to said first and second support members at locations substantially adjacent said first and second support members second ends.

8. A folding bed as defined in claim 7, further comprising a retaining member defining a retaining member first end and a longitudinally opposed retaining member second end, said retaining member first end being pivotally attached to said first supporting section intermediate said first supporting section first and second ends, said retaining member second end being pivotally attached to said bed frame substantially adjacent said bed frame first end, wherein said retaining member constrains the movement of said first supporting section such that when said first and second supporting sections are moved from said elongated configuration to said bent configuration, said second supporting section second end is moved towards said bed frame first end.

9. A folding bed as defined in claim 8, wherein said bed frame includes a storage compartment provided substantially adjacent said frame base second end.

10. A folding bed as defined in claim 9, wherein said storage compartment includes a storage compartment body and a lid pivotally linked to said storage compartment body, said lid being operable between a lid closed position wherein said lid is substantially parallel to said frame base and a lid open position wherein said lid is substantially non-parallel to said frame base and extends substantially upwardly therefrom, said lid being covered at least in part by said second supporting member when said folding bed is in said elongated configuration, said lid being substantially uncovered by said second supporting section when said folding bed is in said bent configuration, thereby allowing the operation of said lid between said lid open and closed configurations.

11. A folding bed as defined in claim 10, wherein said lid includes an entertainment device.

12. A folding bed as defined in claim 11, wherein said entertainment device includes a display device.

13. A folding bed as defined in claim 10, wherein said second supporting member is operatively coupled to said storage compartment so that said second supporting member abuts said storage compartment while allowing a translational motion of said second supporting member with respect to said storage compartment.

14. A folding bed as defined in claim 7, wherein said lower limbs each include a lower leg portion and an upper leg portion articulated to said a respective lower leg portion at a respective knee region, said upper leg portions being linked to said hip region, said second supporting section including a second supporting section first segment for supporting said lower leg portions and a second supporting section second segment for supporting said upper leg portions, said second supporting section second segment being pivotally linked to said second supporting section first segment.

15. A folding bed as defined in claim 14, wherein said second support member is attached to said second supporting section second segment.

16. A folding bed as defined in claim 15, wherein said first-to-second section pivotal link includes a substantially planar first-to-second section pivotal member hinged:

to said second supporting member at a location substantially adjacent said second supporting member first end; and to said first supporting member at a location substantially adjacent said first supporting second first end.

17. A folding bed as defined in claim 16, wherein a pivotal member-to-first supporting section angle between said first-to-second section pivotal member and said first supporting section in said bent configuration is from about 55 degrees to about 80 degrees.

18. A folding bed as defined in claim 17, wherein a pivotal member-to-first supporting section angle in said bent configuration is about 65 degrees.

19. A folding bed as defined in claim 18, wherein in said bent configuration, said first-to-second section angle is from about 80 degrees to about 100 degrees.

20. A folding bed as defined in claim 7, wherein said section pivotal link-to-first support member distance is from about 10% to about 30% of the distance between said first supporting section first and second ends.

* * * * *